US008892022B2

(12) United States Patent
Arimura et al.

(10) Patent No.: US 8,892,022 B2
(45) Date of Patent: Nov. 18, 2014

(54) IMAGE FORMING APPARATUS WITH A CLEANING BLADE

(75) Inventors: Koji Arimura, Toride (JP); Isao Komatsu, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 239 days.

(21) Appl. No.: 13/484,807

(22) Filed: May 31, 2012

(65) Prior Publication Data

US 2012/0308257 A1 Dec. 6, 2012

(30) Foreign Application Priority Data

Jun. 2, 2011 (JP) ..... 2011-124583
Mar. 12, 2012 (JP) ..... 2012-053948

(51) Int. Cl.
*G03G 21/00* (2006.01)
*G03G 15/16* (2006.01)

(52) U.S. Cl.
CPC .... *G03G 21/0017* (2013.01); *G03G 2215/0129* (2013.01)
USPC ..... 399/350; 399/101

(58) Field of Classification Search
CPC ..... G03G 21/0017
USPC ..... 399/99, 101, 350
See application file for complete search history.

(56) References Cited

U.S. PATENT DOCUMENTS

| | | | | |
|---|---|---|---|---|
| 7,245,864 | B2 * | 7/2007 | Fujiwara | 399/350 X |
| 7,630,678 | B2 * | 12/2009 | Kishi et al. | 399/350 |
| 7,773,934 | B2 * | 8/2010 | Kishi et al. | 399/350 |
| 7,778,585 | B2 * | 8/2010 | Uchida et al. | 399/350 |

FOREIGN PATENT DOCUMENTS

| | | | |
|---|---|---|---|
| JP | 2003-122222 | A | 4/2003 |
| JP | 2007-34248 | A | 2/2007 |
| JP | 2009-63993 | A | 3/2009 |
| JP | 2010-145901 | A | 7/2010 |

* cited by examiner

*Primary Examiner* — Sandra Brase
(74) *Attorney, Agent, or Firm* — Canon USA, Inc., IP Division

(57) ABSTRACT

A width of an untreated section in a drum blade is shorter than a width of an untreated section in an intermediate transfer member blade in an image forming apparatus using a blade, ends of which a treatment with high hardness is applied to, for both cleaning blades in a drum and an intermediate transfer member.

8 Claims, 19 Drawing Sheets

IMAGE FORMING APPARATUS WITH A CLEANING BLADE

BACKGROUND OF THE INVENTION

1. Field of the Invention

The present invention relates to an image forming apparatus such as a copying machine, a printer, and a facsimile employing an electrophotographic method or an electrostatic recording method, and particularly an image forming apparatus using a cleaning blade.

2. Description of the Related Art

Conventionally, a cleaning blade composed of an elastic material such as urethane rubber has been widely used as a cleaning unit for cleaning residual toners and the like.

Rubber materials such as urethane rubbers that have high hardness, and are rich in elasticity and excellent in abrasion resistance, mechanical strength, oil resistance, and ozone resistance are commonly used as the rubber material for the cleaning blade.

A slippage between an image bearing member and a blade is primarily maintained by toner or an external additive contained in the toner, but an amount of the toner that reaches both ends of the image bearing member is much lower than an amount of the toner that reaches a central portion of the image bearing member. Thus, the slippage of the cleaning blade is not maintained, and a phenomenon that the cleaning blade is wrongly turned up with starting from an end of a lengthwise direction (hereinafter, blade turn-up) occurs easily.

In recent years, the invention for reducing the blade turn-up in which a cleaning blade is processed by impregnating a total lengthwise area of the rubber material that forms the cleaning blade with an isocyanate compound, and by applying isocyanate onto the ends in the lengthwise direction of the cleaning blade to increase a rubber hardness of the end of the lengthwise direction and lower a coefficient of friction with the image bearing member has been discussed as a method for preventing the blade turn-up (Japanese Patent Application Laid-Open No. 2009-63993).

However, when a section subjected to treatment to increase the hardness is formed on the both ends in the lengthwise direction of the cleaning blade, a difference in level may occur at an internal end of the treated section (hereinafter, a section treated with high hardness), which is a border between the section treated with the high hardness and an untreated section upon abutting the cleaning blade on the image bearing member, by swelling of the section treated with the high hardness. In addition, the toner sometimes escapes from the difference in level.

Further, in the image forming apparatus using an intermediate transfer member, it is likely that the toner that escapes from the cleaning blade on the image bearing member is transferred and accumulated on the intermediate transfer member and subsequently transferred onto a recording material to cause image defect.

SUMMARY OF THE INVENTION

The present invention is directed to a technique for inhibiting a failure caused by taking around a toner escaped from a border of a section treated with high hardness on an intermediate transfer member while inhibiting a turn-up of blade member ends in an image forming apparatus in which an image bearing member and the intermediate transfer member are cleaned by a blade member, the ends of which are treated with the high hardness.

According to an aspect of the present invention, an image forming apparatus includes an image bearing member on which an electrostatic latent image is formed, a developing device configured to develop the electrostatic latent image on the image bearing member to make a toner image, a first blade member including a first treated section treated with high hardness in both ends of an abutting portion abutting on the image bearing member and configured to remove a toner remained on the image bearing member, an intermediate transfer member configured to transfer the toner image from the image bearing member and carry the toner image, and a second blade member including a second treated section treated with high hardness in both ends of an abutting portion abutting on the intermediate transfer member and configured to remove toner remained on the intermediate transfer member, wherein a second region in which a layer thickness of the second blade member is changed at a border between the second treated section and an untreated section which is not treated with high hardness is provided on a more outer side than a first region in which a layer thickness of the first blade member is changed at a border between the first treated section and an untreated section which is not treated with high hardness in an axis line direction of the image bearing member Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 2:
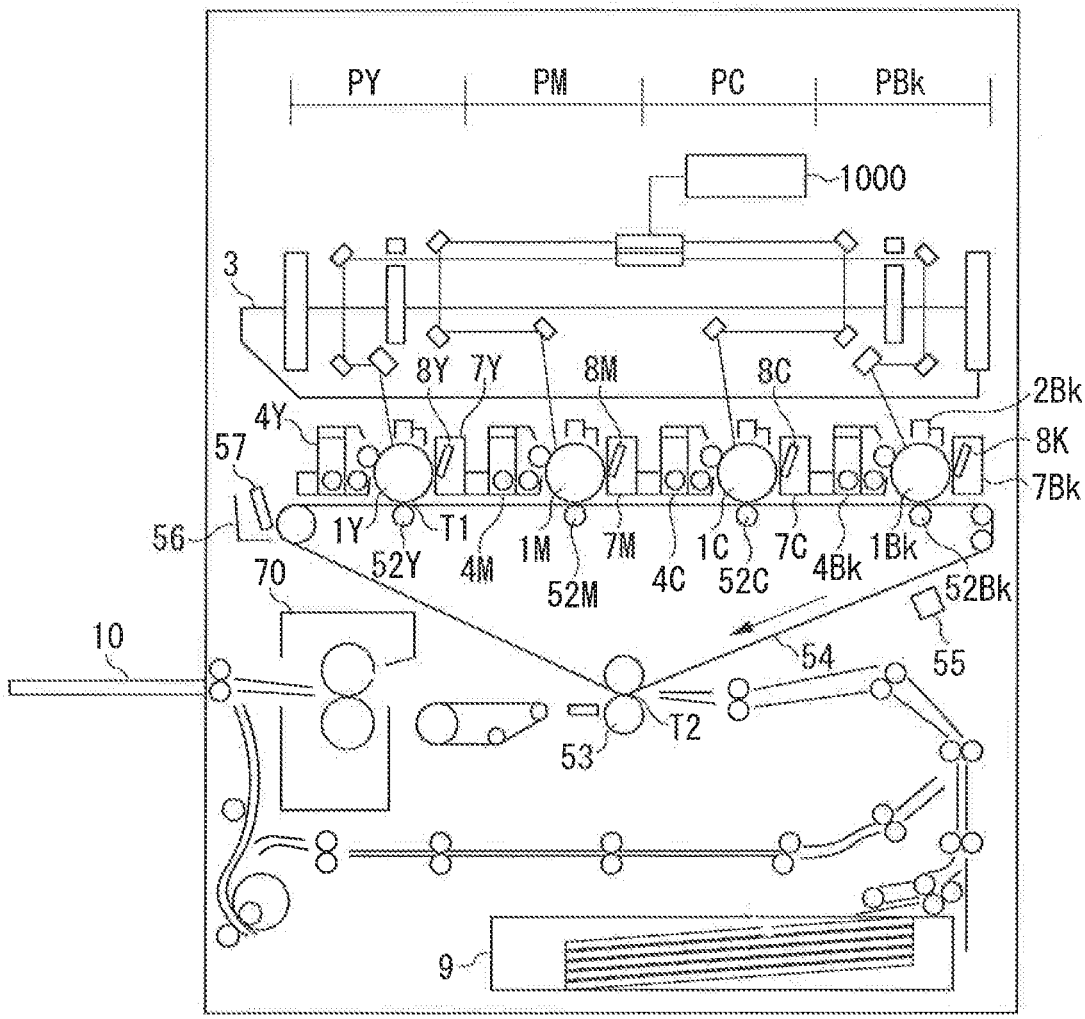
FIG. 2 is a schematic drawing illustrating a configuration of an image forming apparatus according to the first exemplary embodiment.

FIG. 2 illustrates a schematic configuration of an image forming apparatus in a first exemplary embodiment.

When image formation is started, a moving optical system is operated and a document surface of a recording material is optically scanned. Accordingly, image information on the document surface is photoelectrically read out as electric image signals by an image sensor, (i.e., a charge coupled device (CCD)) and input in a controller 1000. The controller (i.e., central processing unit (CPU)) 1000 functioning as a controlling unit resolves the signals of the input image information into color components of yellow (Y), cyan (C), magenta (M), and black (Bk). Further the controller 1000 controls image forming operations of image forming units (PY, PM, PC, and PBk) including an image forming process unit of respective colors according to a controlling program and a reference table, based on the signals of the input image information of the respective colors.

The image forming operation performed on a photosensitive drum (1Y, 1M, 1C, 1Bk) that is an image bearing member in each color image forming unit is described using a yellow image forming unit PY. Hereinafter, the yellow image forming unit PY is collectively referred to as an image forming unit P and a yellow photosensitive drum 1Y is collectively referred to as a photosensitive drum 1 because the constitutions for the respective colors are approximately the same.

A photosensitive drum 1 on which a toner image is formed and which is a rotatable image bearing member is driven to rotate in a direction indicated by an arrow at a predetermined rotation speed (process speed).

The surface of the photosensitive drum 1 is evenly charged to predetermined polarity and potential by a primary charging roller 2 that is a primary charging unit as a charging unit. The primary charging roller 2 is a contact type charging roller that is rotated with following the rotation of the photosensitive drum 1.

A predetermined primary charging bias is applied to the primary charging roller 2 from a power supply source for applying the charging bias (not illustrated). In the present exemplary embodiment, the charging bias is a superimposed bias of an alternating current (AC) bias and a direct current (DC) bias.

An image is exposed on the charged surface of the photosensitive drum 1 by a laser scanner 3 functioning as an exposure unit to form an electrostatic latent image. The laser scanner 3 outputs laser light modified in response to the image information input from the controller 1000 to scan and expose the surface of the photosensitive drum.

A direction (drum lengthwise direction) orthogonal to a rotation direction (sub scanning direction) of the photosensitive drum 1 is a main scanning direction, and the rotation direction of the photosensitive drum 1 is a sub scanning direction. The electrostatic latent image (latent image pattern) corresponding to an original image read out is formed on the surface of the photosensitive drum by the scanning and exposure processing.

The electrostatic latent image is developed as a toner image by a development device 4 functioning as a developing unit. The development device 4 is a developing roller 5 (developing sleeve) as a developer bearing member that carries the toner (developer), supplies the toner to the electrostatic latent image and develops the electrostatic latent image on the photosensitive drum 1. The development device 4 is driven to rotate in a counterclockwise direction of an arrow by a driving unit (motor, not illustrated). A predetermined developing bias is also applied by a power supply source for applying the developing bias (not illustrated).

A primary transfer bias is applied to the toner image formed on the photosensitive drum 1 in a primary transfer section T1 at which the photosensitive drum 1 faces to a primary transfer roller 52 as a primary transfer unit, and the toner image is transferred onto an intermediate transfer member 54. The toner image transferred onto the intermediate transfer member 54 is conveyed toward a secondary transfer section T2.

Meanwhile, a residual toner remained on the photosensitive drum 1 without being transferred after passing the primary transfer section T1 is scraped from the surface of the photosensitive drum by a drum blade 8 provided in a drum cleaning unit 7. The scraped residual toner is recovered in a toner containing container.

The above image forming operation is also performed in a magenta image forming unit PM, a cyan image forming unit PC, and a black image forming unit PBk, and the toner images of respective color components are superimposed sequentially on the intermediate transfer member 54.

A predetermined charge is given from a post charging device 55 to the toner image superimposed on the intermediate transfer member, and the toner image is subsequently conveyed to the secondary transfer section T2.

In the secondary transfer section T2, the toner image on the intermediate transfer member is transferred onto a recording material that is a recording medium supplied from a sheet feeding unit 9 (i.e., a sheet feeding cassette). In the present exemplary embodiment, a nip section between the intermediate transfer member 54 and a secondary transfer roller 53 is the secondary transfer section T2. A transfer bias at a predetermined potential with a polarity reverse to the polarity of the charged toner is applied from a power supply source for applying the transfer bias (not illustrated). Accordingly, the toner image on the intermediate transfer member is transferred onto the surface of the recording material which is nipped and conveyed through the secondary transfer section T2.

The recording material is stacked and stored in the sheet feeding cassette 9, one sheet is separated and supplied by a sheet feeding roller driven at a predetermined control timing, and comes to a registration roller through a recording material conveyance path.

The recording material passed through the secondary transfer section T2 is further passed through a recording material conveyance path, and nipped and conveyed at a fixing nip portion in a fixing device 70 functioning as a fixing unit. Accordingly, an unfixed toner image on the recording material is fixed as a fixed image on the surface of the recording material. Then, the recording material exits from the fixing device 70 and is discharged to a sheet discharge tray 10 by a sheet discharge roller.

The residual toner, paper powders, and the like remained on the intermediate transfer member are cleaned by an intermediate transfer member cleaning apparatus 56. The intermediate transfer member cleaning apparatus 56 abuts on the intermediate transfer member 54, and includes an intermediate transfer member blade 57 that removes the residual toner and paper powders on the intermediate transfer member.

Here, the drum blade 8, which is a first blade member, and the intermediate transfer member blade 57, which is a second blade member, are elastic blades composed of a rubber material such as urethane rubber. The elastic blade is described using the intermediate transfer member blade 57 as an example. The intermediate transfer member blade 57 is provided along a lengthwise direction of the intermediate transfer member 54 and in a counter direction to the rotation direction of the intermediate transfer member 54. Further, the intermediate transfer member blade 57 forms a nip portion (cleaning section) abutting on a predetermined area of the intermediate transfer member 54 at an edge portion on a side of the intermediate transfer member blade 57 abutting on the intermediate transfer member. The surface of the intermediate transfer member is cleaned by the intermediate transfer member blade 57, and residues such as the residual toner and paper powders are removed. The removed residual toner and the like are subsequently recovered in a cleaning container 56.

[Molding of Blade]

Here, a method for manufacturing the blade that includes the drum blade 8 as the first blade member and the intermediate transfer member blade 57 as the second blade member in the present exemplary embodiment is described using the drum blade 8 as an example. The drum blade in the present exemplary embodiment is composed of the rubber material and manufactured from a polyisocyanate compound and a polyfunctional active hydrogen compound.

As the polyisocyanate compound used in the present exemplary embodiment, it is preferable to use a prepolymer or a semi-prepolymer obtained by reacting usual polyisocyanate with macromolecular polyol, which is the polyfunctional active hydrogen compound.

A content of an isocyanate group (NCO %) in the prepolymer or the semi-prepolymer is preferably 5 to 20% by mass in order to realize a good elastic property. The content of the isocyanate group (NCO %) is the percent by mass of the isocyanate functional group (NCO calculated using a molecular weight of 42) contained in the prepolymer or the semi-prepolymer, which is a raw material of a polyurethane resin.

Specific examples of polyisocyanate typically used for preparing the prepolymer or the semi-prepolymer can include diphenylmethane diisocyanate (MDI), tolylene diisocyanate (TDI), naphthalene diisocyanate (NDI), and hexamethylene diisocyanate (HDI).

Specific examples of the macromolecular polyol, which is the active hydrogen compound for preparing the prepolymer or the semi-prepolymer can include polyester polyol, polyether polyol, caprolactone ester polyol, polycarbonate ester polyol, and silicone polyol. It is typically preferable that its weight average molecular weight be 500 to 5,000.

Specific examples of a cross-linking agent can include 1,4-butanediol, 1,6-hexanediol, ethylene glycol, and trimethylolpropane.

When the above polyisocyanate compound is reacted with macromolecular polyol, polyisocyanate, and the cross-linking agent, a common catalyst used for forming the polyurethane resin is sometimes added. Specific examples of such a catalyst include triethylenediamine.

As a method for forming the drum blade 8 made from the polyurethane resin in the present exemplary embodiment, macromolecular polyol, polyisocyanate, the cross-linking agent, and the catalyst are mixed at a time, and the mixture is poured and molded into the mold to form the drum blade. At that time, the drum blade 8 composed of the polyurethane resin is formed directly on a support member 20, and a tip section of the drum blade 8 formed from the polyurethane resin is cut in order to precisely make a portion abutting on the photosensitive drum 1.

A method in which a sheet shaped rubber material is formed and cut into a size to be used, and a part of the rubber material is attached to the support member 20 with an adhesive may be employed as another method for forming the drum blade 8.

[Formation of Section Treated with High Hardness]

A method for forming a first section treated with high hardness in the drum blade 8, which is obtained as described above and formed from the polyurethane resin, is described. A second section treated with high hardness in the intermediate transfer member blade is formed in the similar manner.

The method for forming the first section treated with high hardness can include a method including the following steps.

(1) Step of contacting the isocyanate compound with both ends in a lengthwise direction of a portion abutting on the photosensitive drum in the drum blade 8 formed from the polyurethane resin;

(2) step of impregnating the drum blade 8 with the isocyanate compound by contacting the isocyanate compound with the surface of the drum blade and leaving the blade as it stands;

(3) step of removing the isocyanate compound remaining on the surface of the drum blade 8 after the impregnation; and (4) step of forming the section treated with high hardness by reacting the isocyanate compound impregnated in the drum blade.

More specifically, the both ends in the lengthwise direction of the tips abutting on the photosensitive drum in the drum blade formed from the polyurethane resin are impregnated with the isocyanate compound in the steps (1) and (2). Subsequently, the excess isocyanate compound is removed in the step (3), and the section treated with high hardness is formed by reacting the isocyanate compound in the step (4).

In the step (4), it is conceivable that the polyurethane resin that forms the drum blade 8 is reacted with the isocyanate compound to form an allophanate bond, so that the section treated with high hardness having the high hardness is formed. Thus, the drum blade 8 is provided with the section treated with high hardness on one end and the other end in the lengthwise direction thereof.

A urethane bond including active hydrogen is present in the polyurethane resin that forms the drum blade 8. It is conceivable that the urethane bond is reacted with the impregnated isocyanate compound to form the allophanate bond, so that the section treated with the high hardness having the high hardness is formed in the step 4.

Further, it is conceivable that a multimerization reaction by the reaction of the isocyanate compounds one another (e.g., carbodiimidization reaction, and isocyanuration reaction) is carried forward simultaneously to contribute to the formation of the section treated with high hardness. As a result, it is conceivable that the hardness of the section treated with high hardness can be enhanced, a friction coefficient of the blade with the photosensitive drum can be reduced, durability of the drum blade 8 can be enhanced, and the blade turn-up can be reduced. In particular, the slippage between the image bearing member and the blade is primarily maintained by the toner and the external additive contained in the toner, but the amount of the toner that reaches the both ends of the image bearing member is much lower than the amount of the toner that reaches the central portion. Thus, the slippage of the cleaning blade is not maintained, and the phenomenon that the cleaning blade is wrongly turned up with starting from ends in the lengthwise direction (hereinafter, blade turn-up) occurs easily.

The isocyanate compound including one isocyanate group in its molecule and the isocyanate compound including two or more isocyanate groups in its molecule can be used as the isocyanate compound with which the drum blade 8 is impregnated. The isocyanate compound including one isocyanate group in its molecule can include aliphatic monoisocyanate such as octadecylisocyanate (ODI) and aromatic monoisocyanate.

As the isocyanate compound including two isocyanate groups in its molecule with which the drum blade 8 is impregnated, 2,4-tolylene diisocyanate, 2,6-tolylene diisocyanate, 4,4'-diphenylmethane diisocyanate (MDI), m-phenylene diisocyanate, tetramethylene diisocyanate, hexamethylene diisocyanate, and the like can be used.

In the present exemplary embodiment, the polyurethane resin may also be impregnated with the catalyst in addition to the isocyanate compound in order to facilitate the reaction of the isocyanate compound.

The impregnation of the blade with the isocyanate compound can also be performed, for example, by impregnating a fibrous member or a porous member with the isocyanate compound and coating the blade with the fibrous member or the porous member or applying the fibrous member or the porous member to the blade using a spray.

The blade is impregnated with the isocyanate compound for a predetermined time period as described above. The time period for treating the blade can vary according to the image forming apparatus and a member to abut. Further, an optimal treatment time period and treated width may be employed separately for the drum blade and the intermediate transfer member blade.

The time period for contacting the isocyanate compound with the blade formed from the polyurethane resin is preferably 5 minutes or more and more preferably 10 minutes or more in order to accomplish the range of a treated region of the blade in the present exemplary embodiment.

Then, the isocyanate compound remaining on the surface of the blade is wiped out using a solvent that can dissolve the isocyanate compound in the step (3).

After passing through the above steps, the impregnated isocyanate compound is reacted to form the allophanate bond or nearly consumed by the reaction with moisture in the air to form a white opaque treated layer having the high hardness.

Figure 3:
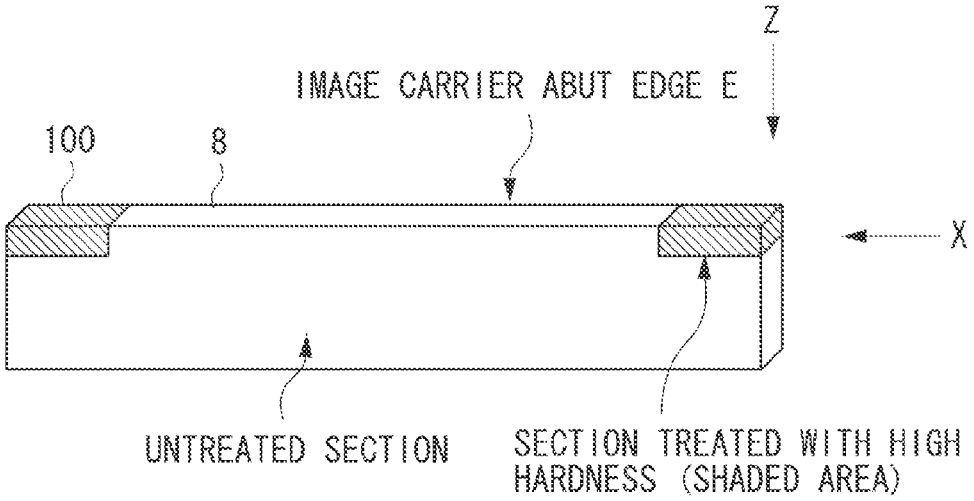
FIG. 3 illustrates a blade treated with high hardness according to the first exemplary embodiment.

The drum blade 8, predetermined areas of both ends of which have been treated with high hardness as illustrated in FIG. 3 can be obtained. The section impregnated with the isocyanate compound in the drum blade is swelled to a Y direction that is a thickness direction of the blade.

Figure 4:
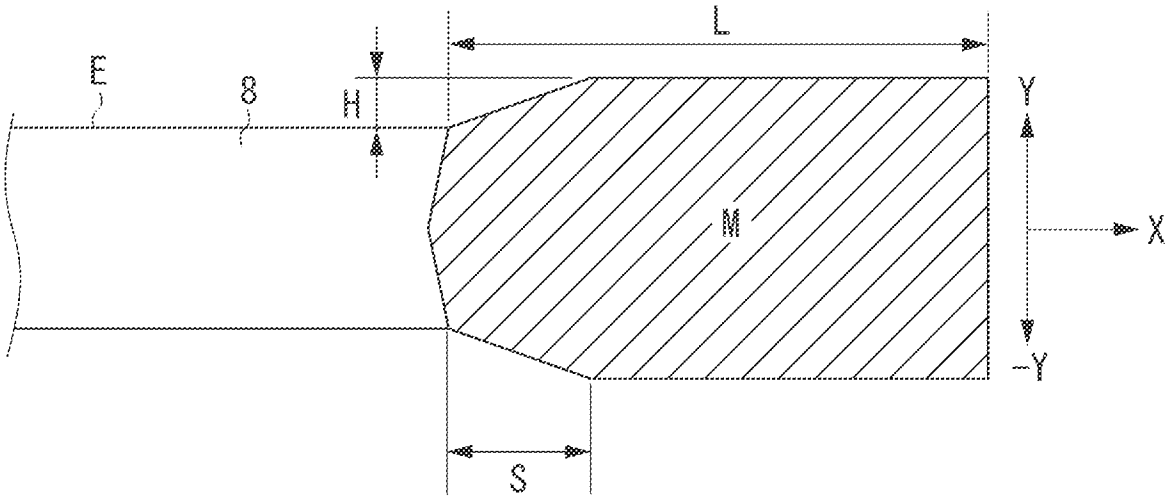
FIG. 4 illustrates the blade according to the first exemplary embodiment, viewed from a Z direction in FIG. 3.
Figure 5:
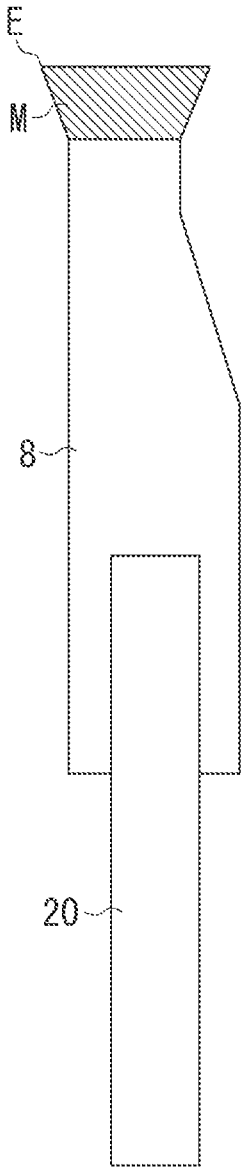
FIG. 5 illustrates the blade according to the first exemplary embodiment, viewed from an X direction in FIG. 3.

FIG. 4 is a schematic diagram viewed from a perpendicular upper direction (Z direction illustrated in FIG. 3) to the lengthwise direction with magnifying the end of the drum blade 8 in the present exemplary embodiment. FIG. 5 is a schematic diagram viewed from the lengthwise direction (X direction illustrated in FIG. 3) with magnifying the end of the drum blade 8 in the present exemplary embodiment.

The blade in a width direction (Y direction) is swelled by impregnating the drum blade formed from the polyurethane resin with the isocyanate compound. A swelled width H is a distance in the width direction (Y direction) in the blade between an edge portion E, which is the untreated section of the drum blade abutting on the photosensitive drum, and an edge portion E, which is the section treated with high hardness of the blade abutting on the photosensitive drum.

A treated width L of the drum blade 8 is a distance from one end in the lengthwise direction of the drum blade to a border between the section treated with high hardness and the untreated section of the edge E abutting on the drum.

When the section treated with high hardness is formed by impregnating with the isocyanate compound, an internal end portion 100 in the section treated with high hardness exhibits a structure illustrated in FIG. 4. More specifically, there is a region S in which the swelled width is gradually reduced from a maximum swelled width toward an internal side of the lengthwise direction. Here, the toner is escaped from a region where the swelled width is changed from 90% to 10% based on the maximum swelled width in the above region S. Thus, the region where the swelled width is changed from 90% to 10% based on the maximum swelled width in the above region S is referred to as a layer thickness change region.

[Positional Relation of Section Treated with High Hardness]

Figure 1:
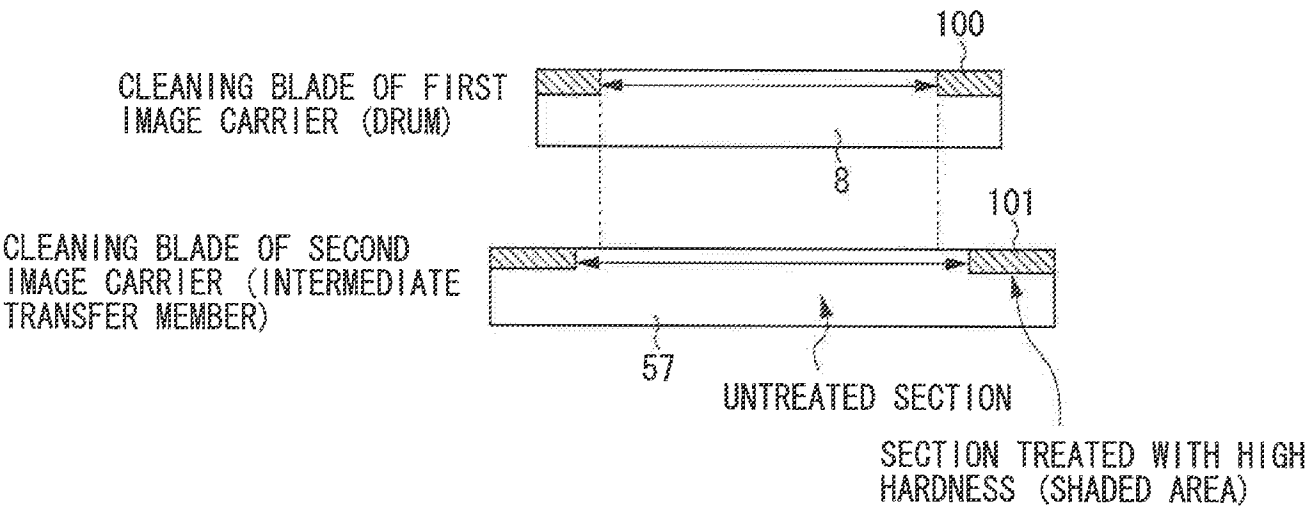
FIG. 1 illustrates a relation in lengthwise widths of sections treated with high hardness in a drum blade and an intermediate transfer member blade according to a first exemplary embodiment.
Figure 6:
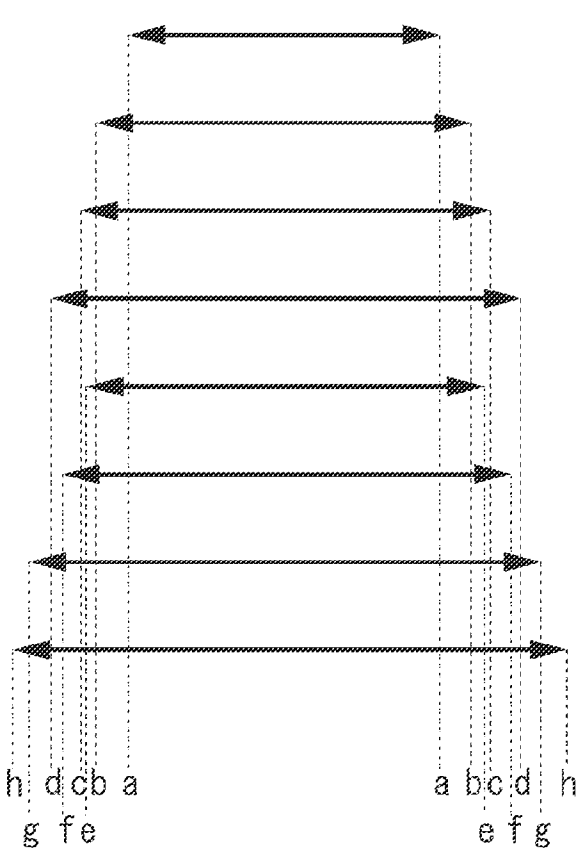
FIG. 6 illustrates a relation in lengthwise widths of the blade and other components according to the first exemplary embodiment.

Subsequently, the positional relation of a first region and a second region is described. The first region and the second region are the layer thickness change regions of the first section treated with high hardness 100 and the second section treated with high hardness 101, which are formed by impregnating the drum blade 8 and the intermediate transfer member blade 57 with the isocyanate compound, respectively. FIG. 1 illustrates the positional relation of the layer thickness change regions of the first section treated with high hardness and the second section treated with high hardness in the drum blade 8 and the intermediate transfer member blade 57, respectively. FIG. 6 illustrates the positional relation of the components such as the drum blade 8, the intermediate transfer member blade 57, the primary transfer roller 52, and the like in the lengthwise direction.

First, there is an image forming region A that is a region where an image can be formed on the surface of the photosensitive drum. In order to enable the image forming region A to be developed in the lengthwise direction, there is a developer bearing region (hereinafter, toner coating region) B where the developer (toner) can be carried to the surface of a developing sleeve 5Y in a region covering the image forming region A. Further, there is a charging region C which can be charged by the charging unit 2 and is wider than the toner coating region B in order to prevent the toner from adhering to the photosensitive drum 1 at a more outer side than the toner coating region B in the lengthwise direction.

However, the wider range than the charging region C and covering to the outer side in the lengthwise direction of the charging region is provided with the drum blade 8 because toner slightly but potentially adheres to the charging region C that is wider than the toner coating region B. Here, respective ends of the image forming region A, the toner coating region B, and the charging region C are designated as the end "a", the end "b", and the end "c".

The section treated with high hardness M by impregnating with the isocyanate compound is formed in the both ends of the drum blade 8 in the lengthwise direction. The primary transfer roller 5 for transferring an image onto the surface of the intermediate transfer member is provided in length covering the toner coating width. A primary transfer region formed by the primary transfer roller is formed to the more outer side than the internal end of the first section treated with high hardness to enable the toner escaped from the drum blade to be transferred to an intermediate transfer belt. A secondary transfer roller 53 that transfers the image on the intermediate transfer member onto the recording material is provided in length covering a maximum sheet-passing width of the recording material.

The intermediate transfer member blade 57 that removes the residual toner remained on the intermediate transfer member is provided in length covering the width of the secondary transfer roller 53. The section treated with high hardness M by impregnating with the isocyanate compound is formed in the both ends of the intermediate transfer member blade 57 in the lengthwise direction. Respective ends of the primary transfer region, the maximum sheet-passing width, the secondary transfer region, and the intermediate transfer member blade 57 are designated as the end "e", the end "f", the end "g", and the end "h".

In an early phase when the drum blade 8 and the intermediate transfer member blade 57 are used, it is likely that the blade is wrongly turned up due to an increased frictional force between the untreated section of the blade and the image bearing member. To prevent the blade turn-up, a lubricant is previously applied on the entire area of the blade in the lengthwise direction.

The treatment with isocyanate is given to the ends of the blades in the present exemplary embodiment, in addition, coating of a fluorine compound or the like may be applied on the ends of the blade as the treatment with the high hardness. However, the coating is easily peeled out compared with the impregnation with isocyanate, and thus, the impregnation such as the treatment with isocyanate is more desirable.

[Evaluation of Cleaning Blade]

A multifunction peripheral manufactured by Canon was used for evaluating these blades. In order to evaluate under a relatively severe environment, the blade turn-up was evaluated under a high temperature and high humidity environment (32.5° C., 80%), and a cleaning property was evaluated under a low temperature and low humidity environment (15° C., 10%). Results in the present exemplary embodiment and comparative examples are shown in Table 1.

In the present exemplary embodiment, the intermediate transfer member blade 57 was made in the similar manner to that for the drum blade 8, and a cleaning blade impregnated with isocyanate for 40 minutes and having a swelled width H of 35 μm and a treated width L of 8 mm was used to assure the hardness required for preventing the turn-up from the end of the blade. The width of the untreated section not treated with isocyanate in the intermediate transfer member blade 57 was made longer than the width of the untreated section in the drum blade 8. Accordingly, the layer thickness change region in the internal end of the second section treated with high hardness 101 in the intermediate transfer member blade 57 was formed on the more outer side in the lengthwise direction than the layer thickness change region in the internal end of the first section treated with high hardness 100 in the drum blade 8.

Figure 7:
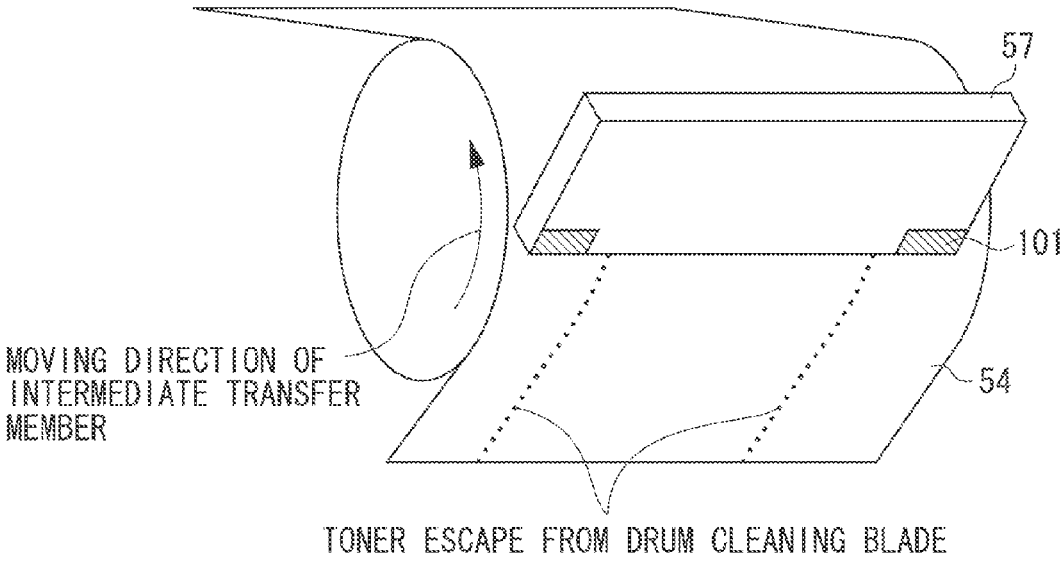
FIG. 7 illustrates how a toner is escaped from the intermediate transfer member blade and the drum blade.

Minor toner escape occurred at the drum blade 8 and the intermediate transfer member blade 57 in the present exemplary embodiment under this condition, but no image defect was visualized on durable 150,000 recording materials because the toner escaped from the drum blade 8 was removed on each escape in the untreated section of the intermediate transfer member blade 57 as illustrated in FIG. 7. No blade turn-up was observed on the ends in the drum blade 8 and the intermediate transfer member blade 57, and good results were shown.

Further, the intermediate transfer member is also reciprocated in the lengthwise direction with rotating. Thus, a minute amount of the toner escaped from a treatment border portion in the intermediate transfer member blade 57 is nearly removed by the region other than the treatment border portion in the intermediate transfer member blade 57 when intermediate transfer member passes through the intermediate transfer member blade while rotating several times. Therefore, no toner streak was also observed on the intermediate transfer member. Similar experiments by changing the treated width and the treated time period for the first and second sections treated with high hardness were also carried out in the following three conditions in the comparative examples. The results are shown in Table 1. It is found to be desirable from these results that the swelled width of the end in the blade is 35 μm or more.

When an approach control is performed on the intermediate transfer member, the intermediate transfer member blade may be provided with the treated section so that the toner escaped from the drum blade is removed in the untreated section in the intermediate transfer member blade even if the intermediate transfer member is moved most closely to the lengthwise direction.

Comparative Example 1

In a comparative example 1, the width of the untreated section in the drum blade 8 was made the same as the width of the untreated section in the intermediate transfer member blade 57. More specifically, the first region and the second region that are the layer thickness change regions of the first section treated with high hardness and the second section treated with high hardness in the drum blade 8 and the intermediate transfer member blade 57, respectively are overlapped in the lengthwise direction. The treatment time period with isocyanate, the swelled width H, the treated width L, and the other experimental conditions in the experiment were the same as in the first exemplary embodiment.

Under these conditions, no blade turn-up from the ends was observed in both the drum blade 8 and the intermediate transfer member blade 57. However, the toner slightly escaped from the drum blade 8 was accumulated on the intermediate transfer member to form the toner streaks, which were transferred on the recording material, resulting in the image defect.

Comparative Example 2

In a comparative example 2, the width of the untreated section in the drum blade 8 was made longer than the width of the untreated section in the intermediate transfer member blade 57. More specifically, the layer thickness change region of the first section treated with high hardness 100 in the drum blade 8 was formed on the more outer side in the lengthwise direction than the layer thickness change region of the second section treated with high hardness 101 in the intermediate transfer member blade 57. The treatment time period with isocyanate, the swelled width H, the treated width L, and the other experimental conditions in the experiment were the same as in the first exemplary embodiment.

Under these conditions, no blade turn-up from the ends was observed in both the drum blade 8 and the intermediate transfer member blade 57. However, a chattering noise due to vibration of the blade that was a warning sign of the blade turn-up occurred. This is thought to be caused probably because the toner in an amount that exceeded a recovery capacity was escaped from the drum blade 8 and came to the region of the second section treated with high hardness.

Further, in a durability late phase, the toner slightly escaped from the drum blade 8 was failed to be recovered in the region of the second section treated with high hardness in the intermediate transfer member blade 57, and the toner streaks were formed on the intermediate transfer member, and transferred onto the recording material, resulting in the image defect.

Comparative Example 3

In a comparative example 3, the width of the untreated section in the intermediate transfer member blade 57 was made the same as the width of the untreated section in the drum blade 8, and further, a level of the impregnation of the intermediate transfer member blade with the isocyanate compound was weakened to reduce the swelled width. Other conditions in the experiment were the same as in the first exemplary embodiment.

Under these conditions, the toner was slightly escaped from the drum blade 8, but the toner escaped from the drum blade 8 was removed by the intermediate transfer member blade 57, and no image defect due to the escaped toner was observed. This is thought to be because the level of the impregnation of the intermediate transfer member blade was weakened and thus the toner was scarcely escaped from the second section treated with high hardness. However, the turn-up of the intermediate transfer member blade 57 occurred in a durability initial phase. Thus, the experiment was terminated at that point in time.

TABLE 1

| | First Exemplary Embodiment | Comparative Example 1 | Comparative Example 2 | Comparative Example 3 |
|---|---|---|---|---|
| Relation of untreated lengthwise width between blade 8 and blade 57 | Blade 8 < Blade 57 | Blade 8 = Blade 57 | Blade 8 > Blade 57 | Blade 8 = Blade 57 |
| Swelled width of drum cleaning blade 8 (μm) | 35 | 35 | 35 | 35 |
| Swelled width of intermediate transfer member cleaning blade 57 (μm) | 35 | 35 | 35 | 15 |
| Blade turn-up | None | None | Slight | Occurred |
| Image defect due to escaped toner | None | Occurred | Occurred | Unknown |

A second exemplary embodiment is characterized in that the width of the isocyanate treatment in the cleaning blade of the photosensitive drum for each color is different, resulting in different widths of the untreated regions in the cleaning blades in an image forming apparatus including a plurality of image forming units, in which the plurality of image forming units are aligned and arranged in the intermediate transfer member. More specifically, the internal end of the first section treated with high hardness in each image forming unit is formed in the more outer side in the lengthwise direction as the image forming unit is located on a more downstream side of the rotation direction of the intermediate transfer member.

Here, the image forming unit is a unit including at least the photosensitive drum that is the image bearing member and the cleaning blade abutting on the photosensitive drum and capable of forming a toner image.

Figure 8:
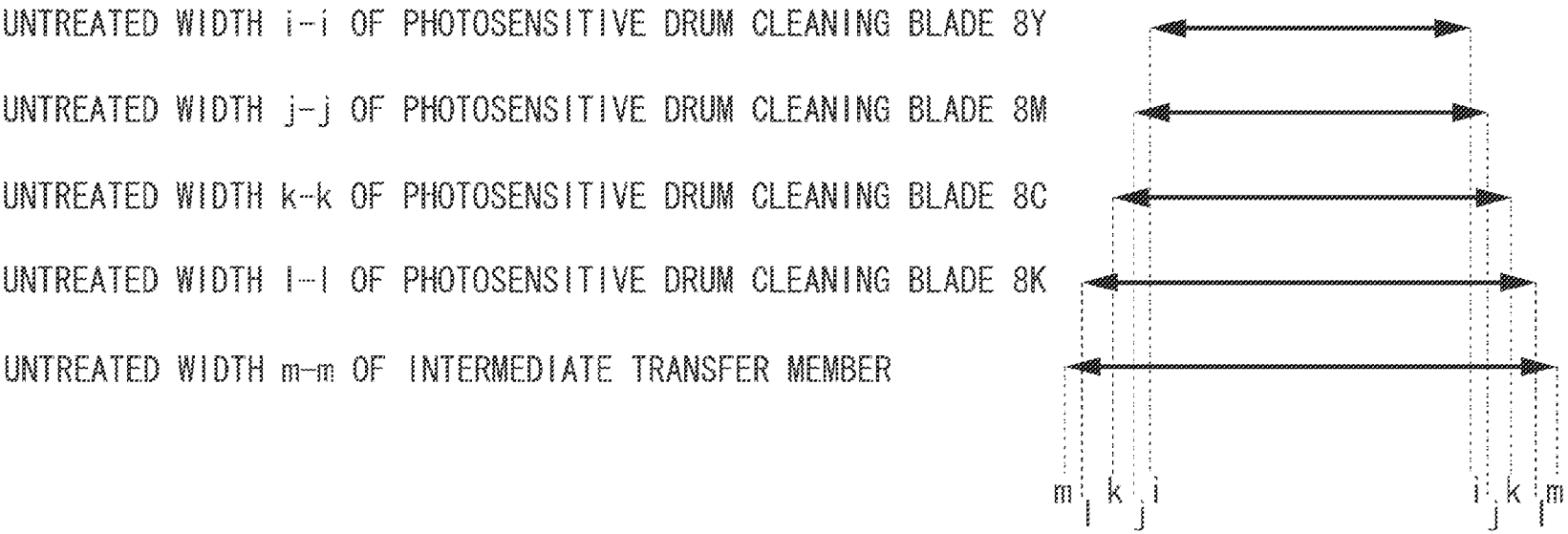
FIG. 8 illustrates a relation in lengthwise directions of cleaning blades and the intermediate transfer member blade in each image forming unit according to a second exemplary embodiment.

FIG. 8 illustrates a relation of widths of untreated sections in drum blades 8Y, 8M, 8C, and 8K of the image forming units for yellow, magenta, cyan, and black, respectively, and the width of the intermediate transfer member blade 57 in the lengthwise direction. As is illustrated in FIG. 8, the border portions of the drum blades for the respective colors are displaced from each other, so that the toner escaped from the border portion of the drum blades is not overlapped on the intermediate transfer member in the present exemplary embodiment.

Further in the present exemplary embodiment, the longer the width of the untreated section of the blade is, the more downstream the image forming unit is arranged. This arrangement is for enhancing the cleaning effect so that the toner escaped from the upstream image forming unit can be removed by the untreated section of the intermediate transfer member blade when the escaped toner is transferred from the intermediate transfer member onto the photosensitive drum of the further downstream image forming unit.

When the width of the untreated section among the respective image forming unit is displaced, if the width is displaced by 0.5 mm or more and preferably 1.0 mm or more, the effect of the present invention is obtained readily.

According to the present exemplary embodiment, even if the toner in a minute amount is escaped from each image forming unit, the position of the toner escape is displaced one another. Thus, when the escaped toner is transferred from the intermediate transfer member to the photosensitive drum of the image forming unit in the downstream, the toner can be removed in the untreated section of the intermediate transfer member blade.

Other exemplary embodiments of the present invention are further described in detail below with reference to the drawings. The present invention can be realized in an another exemplary embodiment in which parts or all of constitutions of the exemplary embodiment are replaced with alternatives of the constitutions as long as a cleaning blade, both ends of which are treated with hardening, is arranged to abut on an image bearing member and an intermediate transfer member, respectively.

Therefore, the present invention can be realized in any of a tandem type/one drum type, and an intermediate transfer type/recording material conveyance type image forming apparatuses. As the image bearing member, not only an organic photosensitive member but also an inorganic photosensitive member such as an amorphous silicon photosensitive member may be used, and not only a photosensitive drum but also a belt-shaped photosensitive member may be used. A charging system, a developing system, a transferring system, a cleaning system, and a fixing system can also be selected arbitrary. Not only a two-component developer but also a one-component developer may be used for a developing device. Only major parts according to formation and transfer of a toner image are described in the present exemplary embodiment, however, the present invention can be realized in various types of image forming apparatuses such as printers, various printing machines, copying machines, facsimiles, and multifunction peripherals by adding necessary instruments, equipments, and housing structures.

[Image Forming Apparatus]

Figure 9:
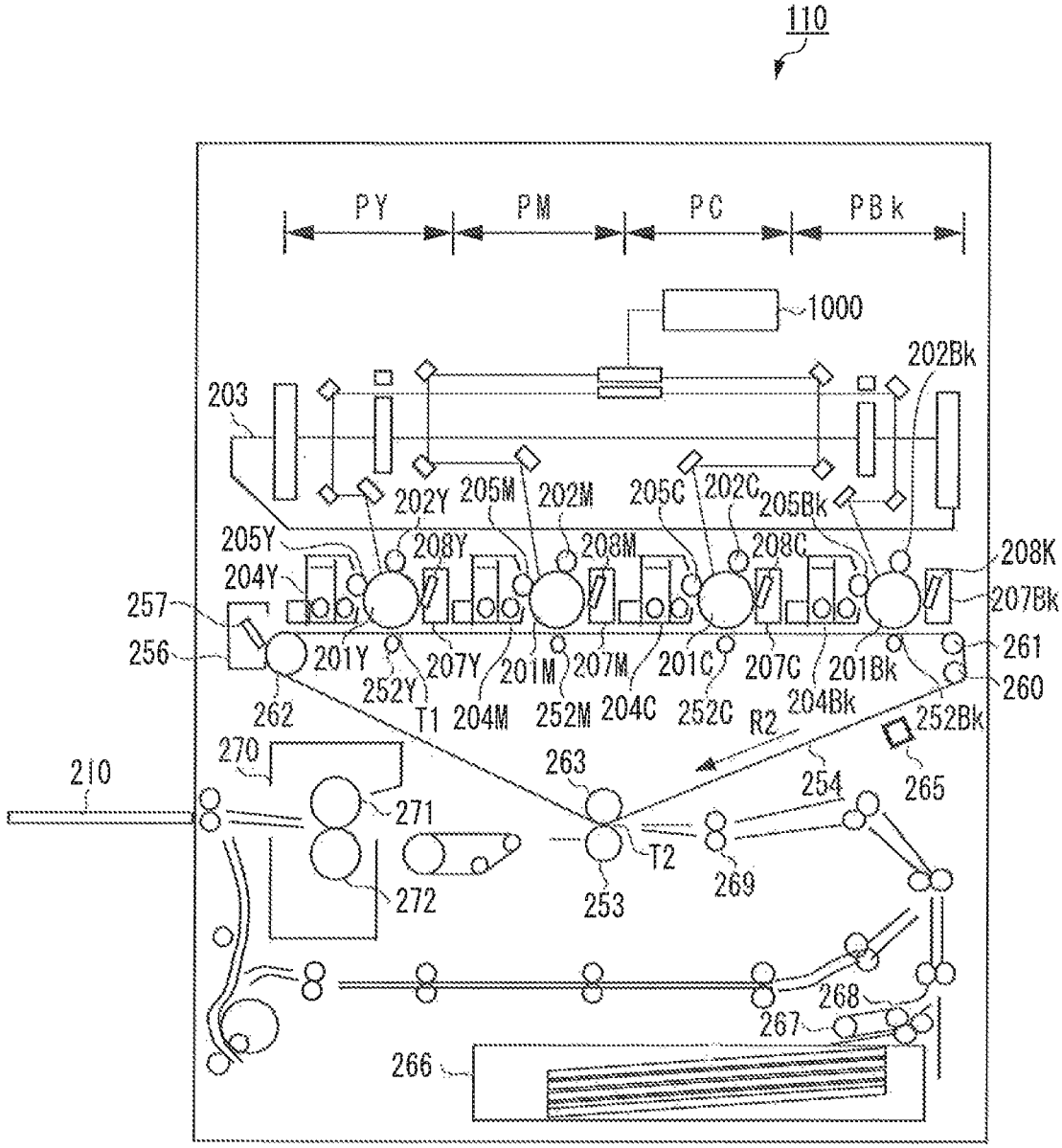
FIG. 9 illustrates a configuration of an image forming apparatus.

FIG. 9 illustrates a configuration of an image forming apparatus. As illustrated in FIG. 9, the image forming apparatus 110 is a full color printer in a tandem type intermediate transfer system in which image forming units PY, PM, PC, and PBk for yellow, magenta, cyan, and black, are arranged along an intermediate transfer belt 254.

In the image forming unit PY, a yellow toner image is formed on a photosensitive drum 201Y and transferred onto the intermediate transfer belt 254. In the image forming unit PM, a magenta toner image is formed on a photosensitive drum 201M and transferred onto the intermediate transfer belt 254. In the image forming units PC and PBk, a cyan toner image and a black toner image are formed on photosensitive drums 201C and 201Bk, respectively, and transferred onto the intermediate transfer belt 254.

The four color toner images transferred onto the intermediate transfer belt 254 are conveyed to a secondary transfer section T2 and secondarily transferred onto a recording material. More specifically, the four color toner images overlapped on the intermediate transfer belt 254 are conveyed to the secondary transfer section T2 after a predetermined charge is given from a post charging device 265 using a corona charging device.

The recording material is taken out by a pickup roller 267 from a recording material cassette 266, separated one by one by a separation roller 268, and fed to a registration roller 269. The registration roller sends out the recording material to the secondary transfer section T2 in synchronized timing with the toner image on the intermediate transfer belt 254. The recording material on which the toner image has been transferred is sent in a fixing device 270, and heated and pressurized in a process of being nipped and conveyed at a nip portion between a fixing roller 271 and a pressing roller 272 to fix the toner image on its surface. The recording material on which the image has been fixed is discharged to a discharge tray 210.

The image forming units PY, PM, PC, and PBk are constituted almost identically except that the colors of the toner used in the developing devices 204Y, 204M, 204C, and 204Bk are different. The image forming unit PY is described below, and the image forming units PM, PC, and PBk are understood by replacing a symbol ending Y with M, C, and Bk in the following description, and thus the duplicated descriptions are omitted.

In the image forming unit PY, a charging roller 202Y, an exposure device 203, a developing device 204Y, a primary transfer roller 252Y, and a drum cleaning device 207Y are arranged in a circumference of a photosensitive drum 201Y. The photosensitive drum 201Y on which a photosensitive layer having a charging property with negative polarity is formed on an outer periphery of an aluminum cylinder is rotated in a direction indicated by an arrow at a predetermined process speed. The charging roller 202Y charges the surface of the photosensitive drum 201Y to an even potential. The exposure device 203 scans laser beams with a rotation mirror and draws an electrostatic latent image on the charged surface of the photosensitive drum 201. The developing device 204Y develops the electrostatic image and forms a toner image on the surface of the photosensitive drum 201Y.

The primary transfer roller 252 presses an internal surface of the intermediate transfer belt 254 to form a primary transfer section T1 of the toner image between the photosensitive drum 201Y and the intermediate transfer belt 254. The toner image with the negative polarity carried on the photosensitive drum 201Y is primarily transferred onto the intermediate transfer belt 254 by applying a direct current voltage with positive polarity to the primary transfer roller 252.

[Charging Roller]

In the charging roller 202Y, a cylindrical conductive elastic layer is arranged on an outer periphery of its metal axis. The charging roller 202, both ends of which are biased toward the photosensitive drum 201Y with springs, is rotated with the rotation of the photosensitive drum 201Y. Oscillation voltage superimposing alternating current voltage to the direct current voltage is applied to the charging roller 202Y, which charges the surface of the photosensitive drum 201Y to a uniform dark portion potential VD with the negative polarity.

[Developing Device]

The developing device 204Y is filled with a developer mixing a toner and a carrier. The developer is conveyed in an opposite and perpendicular direction to a paper surface by a pair of conveyance screws disposed in the developing device 204Y, and mixed and stirred. The toner is charged to the negative polarity and the carrier is charged to the positive polarity along with the stirring. The charged developer is carried by a developing sleeve 205Y that rotates around a magnet roller fixed and disposed without rotation, and conveyed to a developing region facing to the photosensitive drum 201Y. The developer on the developing sleeve 205Y is napped by a magnetic force of a magnetic pole located in the developing region of the magnetic roller to form a magnetic brush. The toner adhered to the magnetic brush is transferred to and develop the electrostatic image on the photosensitive drum 201Y to form the toner image by applying the oscillation voltage superimposing the alternating current voltage to the direct current voltage with the negative polarity to the developing sleeve 205Y, while sliding the magnetic brush of the developer to scrape on the photosensitive drum 201Y.

[Drum Cleaning Device]

The drum cleaning device 207Y scrapes and recovers a transferred residual toner adhered onto the surface of the photosensitive drum 201Y passed through the primary transfer section by abutting a tip of a cleaning blade 208Y on the photosensitive drum 201Y. The cleaning blade 208Y abuts on the photosensitive drum 201Y at a predetermined angle with a predetermined pressure. The transferred residual toner scraped by the cleaning blade 208Y drops in a housing of the drum cleaning device 207Y, conveyed to one end in a lengthwise direction of the housing by a conveyance screw, and discharged in a recovery toner container.

The cleaning blade 208Y is an elastic blade made from the urethane rubber. The cleaning blade 208Y is arranged in a counter direction to the rotation direction of the photosensitive drum 201Y while abutting its edges on a width direction (main scanning direction) orthogonal to a conveyance direction of the toner image. The cleaning blade 208Y forms a cleaning section abutting on a predetermined region of the photosensitive drum 201Y at an edge portion of its blade end.

[Intermediate Transfer Belt]

The intermediate transfer belt 254 is supported by hanging through a steering roller 260, a driving roller 261, a tension roller 262, and a counter roller 263, and rotated in a direction indicated by an arrow R2 at a predetermined process speed. The intermediate transfer belt 254 is reciprocally moved with a long cycle in the width direction orthogonal to the conveyance direction of the toner image along with tilt of the steering roller 260. An endless belt of a polyimide resin having a surface resistivity of $10^{12}\Omega/\square$ and a thickness of 100 μm was used as the intermediate transfer belt 254.

The secondary transfer roller 253 abuts on an outer periphery of the intermediate transfer belt 254, an inner periphery of which is supported by the counter roller 263, to form the secondary transfer section T2 between the secondary transfer roller 253 and the intermediate transfer belt 254. The counter roller 263 is connected to a ground potential, and the direct current voltage with reverse polarity to charging polarity of the toner is applied to the secondary transfer roller 253 upon forming the image. Accordingly, the toner image on the intermediate transfer belt 254 is secondarily transferred onto the recording material.

[Belt Cleaning Device]

Figure 10:
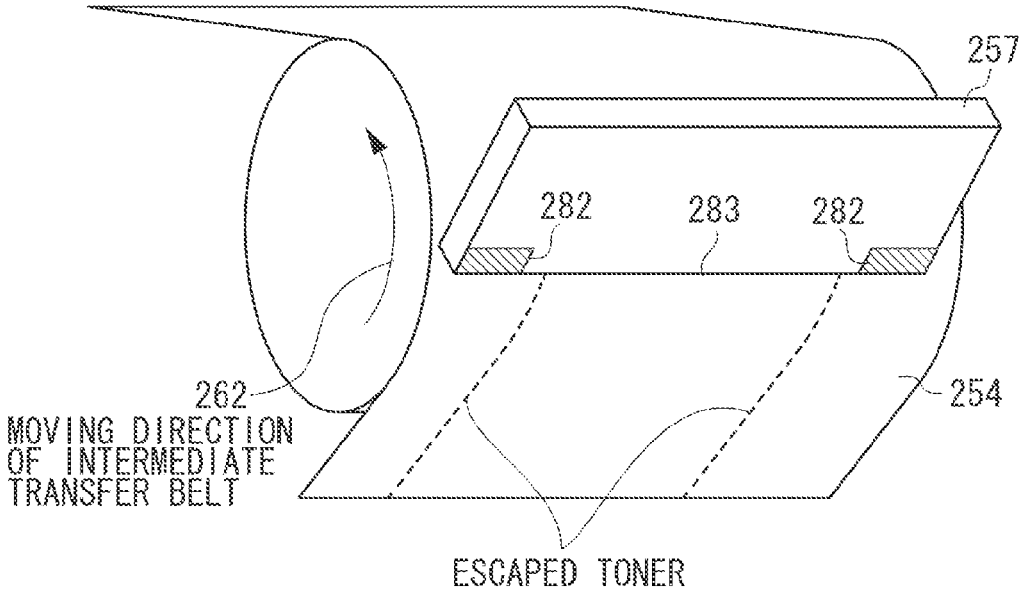
FIG. 10 illustrates a state of a cleaning blade abutting on an intermediate transfer belt.

FIG. 10 illustrates a state of the cleaning belt abutting on the intermediate transfer belt. As illustrated in FIG. 9, a belt cleaning device 256 is arranged on a downstream side of the secondary transfer section T2 in the rotation direction of the intermediate transfer belt 254. The belt cleaning device 256 is constituted almost identically to the drum cleaning device 207Y, and causes a cleaning blade 257 to abut on the intermediate transfer belt 254 to remove and recover the transferred residual toner and paper powders on the intermediate transfer belt 254 passed through the secondary transfer section T2. The transferred residual toner scraped by the cleaning blade 257 drops in the housing of the drum cleaning device 256, conveyed to the one end of the lengthwise direction of the housing by the conveyance screw, and discharged in the recovery toner container.

As illustrated in FIG. 10, the cleaning blade 257 is an elastic blade made from the urethane rubber. The cleaning blade 257 is arranged in the counter direction to the rotation direction of the intermediate transfer belt 254, the inner periphery of which is supported by the tension roller 262 while abutting its edges on the width direction (main scanning direction) orthogonal to the conveyance direction of the toner image. The cleaning blade 257 forms the cleaning section abutting on a predetermined region of the intermediate transfer belt 254 at the edge portion of its blade end.

[Cleaning Blade]

Hereinafter, the cleaning blades 208Y, 208M, 208C, and 208Bk that are the same parts are described as the cleaning blade 208. Along with this, each component illustrated in FIG. 9 is described as a common part excluding a symbol ending, Y, M, V, and Bk.

The cleaning blades 208 (208Y, 208M, 208C, and 208Bk) and 257 composed of a rubber elastic material are common at present as a method for cleaning the transferred residual toner and the like on the photosensitive drum 201 and the intermediate transfer belt 254. Urethane rubber is mainly used as the rubber elastic material for the cleaning blades 208 and 257 because of having high hardness, being rich in elasticity and excellent in abrasion resistance, mechanical strength, oil resistance, and ozone resistance.

As illustrated in FIG. 10, in the case of the cleaning blade 257 of the urethane rubber, the slippage between the intermediate transfer belt 254 and the cleaning blade 257 is primarily maintained by a toner and an external additive contained in the toner. However, since both ends in the width direction orthogonal to the conveyance direction of the toner image are located in margin portions of the recording paper, the toner image is not formed on the photosensitive drum 201 (201Y, 201M, 201C, and 201Bk) illustrated in FIG. 9. Thus, the toner and the external additive contained in the toner are scarcely adhered to the both ends in the width direction of the photosensitive drum 201 and the intermediate transfer belt 254, and an amount of the toner that reaches blade edges of the cleaning blades 208 and 257 is remarkably small.

Thus, the slippage of the cleaning blades 208 and 257 is not maintained, and the both ends of the blade edge is largely pulled to the downstream side to deform and easily cause lifetime reduction and toner escape as compared with a central portion to which the toner is abundantly supplied.

In order to reduce the deformation of the both ends of the blade edge caused by the insufficient toner, a frictional force in the cleaning blades 208 and 257 is reduced by impregnating the both ends in the lengthwise direction of the rubber elastic material as a base with isocyanate and reacting isocyanate to increase the hardness of the rubber.

[Molding of Blade]

Figure 11:
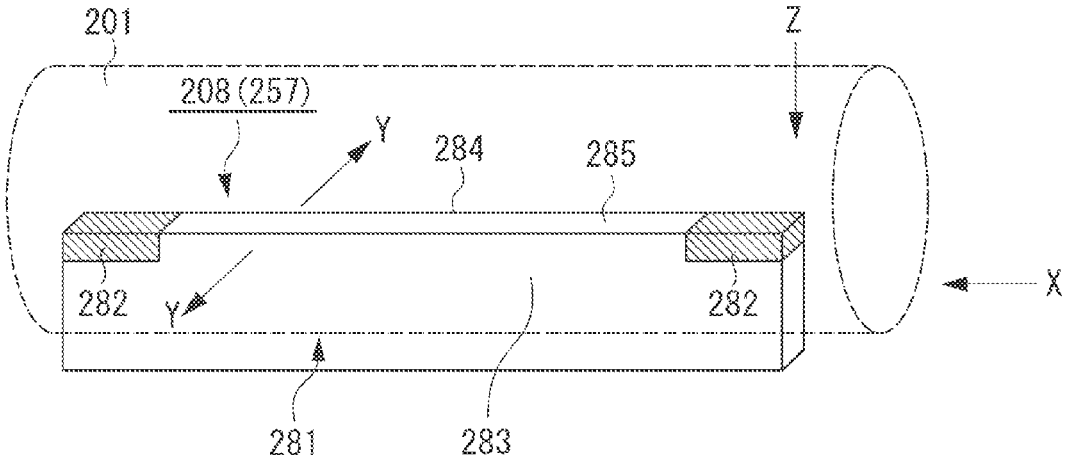
FIG. 11 is a perspective view of the cleaning blade.
Figure 12:
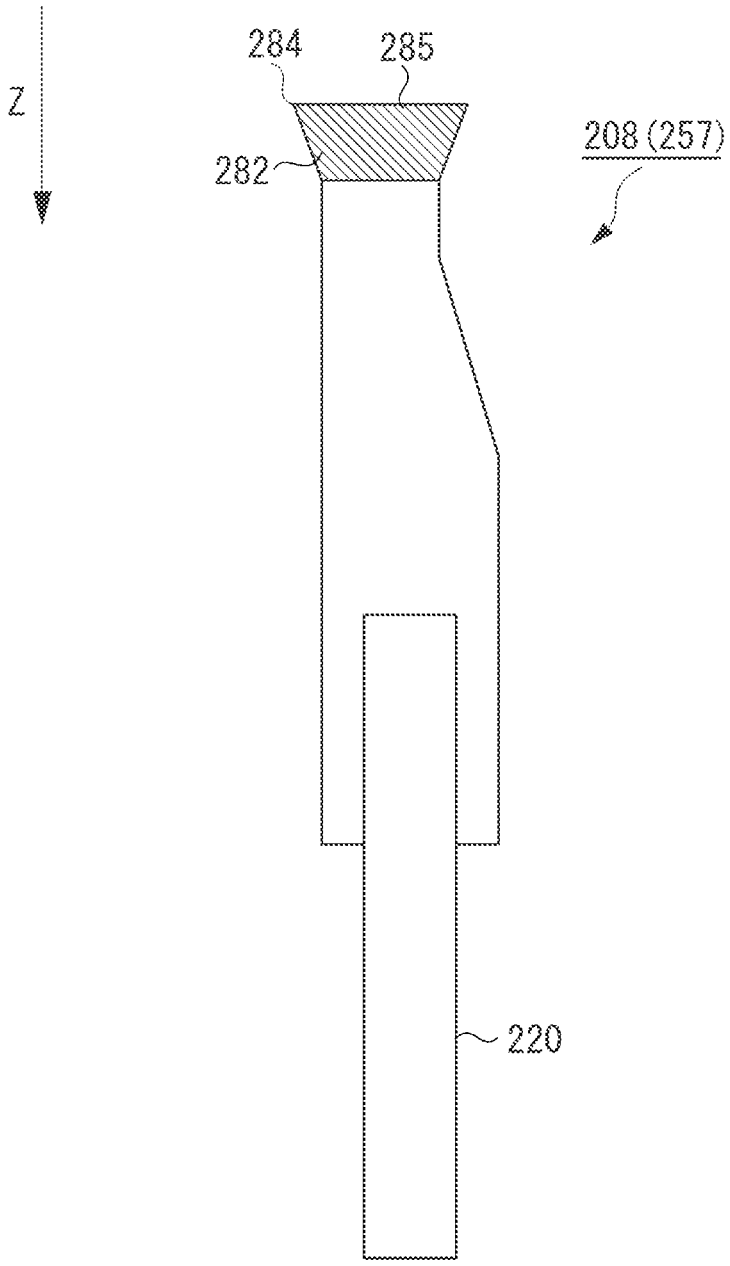
FIG. 12 is a cross-sectional view of the cleaning blade.
Figure 13:
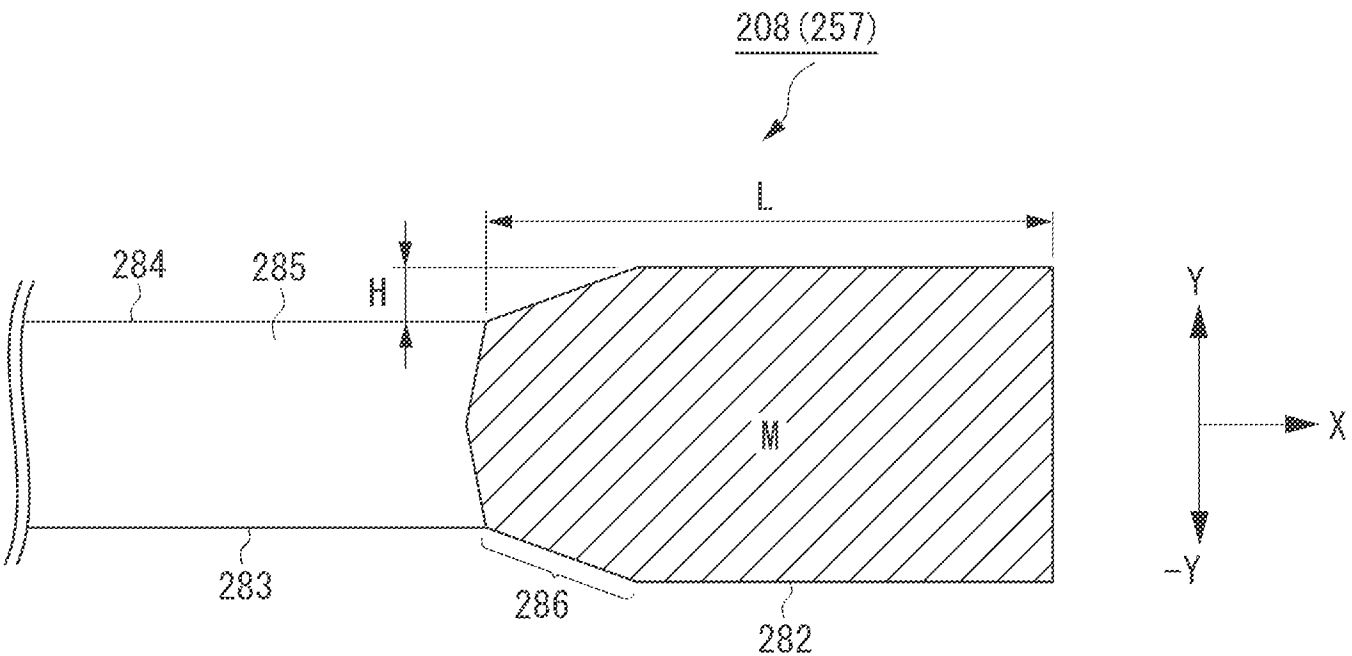
FIG. 13 is a magnified view of an end of a tip of the cleaning blade.

FIG. 11 is a perspective view of the cleaning blade. FIG. 12 is a cross-sectional view of the cleaning blade. FIG. 13 is a magnified view of the end of the tip of the cleaning blade.

As illustrated in FIG. 12, the cleaning blades 208 and 257 are formed by integrally molding a blade section 281 of the urethane rubber on a tip side of a support member 220 of a metal plate. The blade section 281 is produced by cross-linking reaction of a polyisocyanate compound with a polyfunctional active hydrogen compound in a mold in which the support member 220 is placed.

As the polyisocyanate compound, it is preferable to use a prepolymer or a semi-prepolymer obtained by reacting usual polyisocyanate with macromolecular polyol, which is the polyfunctional active hydrogen compound. A content of an isocyanate group (NCO %) in the prepolymer or the semi-prepolymer is preferably 5 to 20% by mass in order to realize a good elastic property. Here, the content of the isocyanate group (NCO %) is the percent by mass of the isocyanate functional group (NCO calculated using a molecular weight of 42) contained in the prepolymer or the semi-prepolymer, which is a raw material of a polyurethane resin.

Specific examples of polyisocyanate typically used for preparing the prepolymer or the semi-prepolymer can include diphenylmethane diisocyanate (MDI), tolylene diisocyanate (TDI), naphthalene diisocyanate (NDI), and hexamethylene diisocyanate (HDI). Specific examples of the macromolecular polyol, which is the active hydrogen compound for preparing the prepolymer or the semi-prepolymer can include polyester polyol, polyether polyol, caprolactone ester polyol, polycarbonate ester polyol, and silicone polyol. It is typically preferable that a weight average molecular weight of these macromolecular polyols be 500 to 5,000.

Specific examples of a cross-linking agent can include 1,4-butanediol, 1,6-hexanediol, ethylene glycol, and trimethylolpropane. When the above polyisocyanate compound is reacted with macromolecular polyol, polyisocyanate, and the cross-linking agent, a common catalyst used for forming the polyurethane resin is sometimes added. Specific examples of a catalyst include triethylenediamine.

The blade section 281 is formed via a reaction of producing the polyurethane resin in the mold. When the blade section 281 is formed, macromolecular polyol, polyisocyanate, the cross-linking agent, and the catalyst are mixed at a time, and the mixture is poured and molded into the mold in which the support member 220 is placed. The blade section 281 composed of the polyurethane resin is directly formed onto the support member 220. In order to precisely make a portion abutting on the photosensitive drum 201, a tip section of the blade section 281 formed from the polyurethane resin is finished by cutting and grinding it.

As another method for molding the blade, a sheet shaped rubber plate material having a thickness of the blade section 281 may be molded, subsequently cut into a size to be used for the cleaning blade 208 (257), and one side of the cut rubber plate material may be attached on the support member 220 with an adhesive.

[Hardening Treatment]

As illustrated in FIG. 11, a section treated with high hardness 282 is formed only in the tip section of the both ends of the cleaning blade 208 (257) formed from the polyurethane resin. The section between the sections treated with high hardness 282 in the both ends is an untreated section 283, which is maintained in an original soft state of the rubber elastic material. One end side and the other end side in the lengthwise direction of the cleaning blade 208 (257) are provided with the section treated with high hardness 282. Accordingly, the cleaning blade 208 (257), the predetermined regions in the both ends of which have been treated with the high hardness and have the flat surface, is obtained. In the figure, an X direction, a Y direction, and a Z direction are a width direction, a thickness direction, and an abutting (length) direction of the cleaning blade 208 (257), respectively.

As illustrated in FIG. 12, a surface layer is hardened by applying the cross-linking agent on a tip surface of the blade section 281 and penetrating it toward the Z direction. As the cross-linking agent is penetrated toward the Z direction, the thickness of the section treated with high hardness 282 is increased further in the tip.

As illustrated in FIG. 13, the thickness of the section treated with high hardness 282 is increased with the penetration of the cross-linking agent, and the difference in thickness between the treated section and the untreated section 283 becomes large. Thus, an abutting pressure in a border region between the section treated with high hardness 282 and the untreated section 283 becomes insufficient, and toner escape easily occurs.

The method for forming the section treated with high hardness 282 in the both ends of the cleaning blade 208 (257) is composed of the following four steps.

Step 1: step of contacting the isocyanate compound with the both ends in the lengthwise direction of the portion abutting on the photosensitive drum in the cleaning blade 208 (257) formed from the polyurethane resin.

Step 2: step of impregnating the cleaning blade 208 (257) with the isocyanate compound by leaving the cleaning blade 208 (257) in a state where the isocyanate compound is contacted with the surface of the cleaning blade 280 (257). Thus, the both ends in the lengthwise direction of the cleaning blade 208 (257) formed from the polyurethane resin is impregnated with an appropriate amount of the isocyanate compound.

Step 3: step of removing the isocyanate compound remaining on the surface of the cleaning blade 208 (257) after the impregnation. The excess isocyanate compound is removed from the surface of the cleaning blade 208 (257).

Step 4: step of forming the section treated with high hardness 282 by reacting the polyurethane resin with the isocyanate compound impregnated in the cleaning blade 208 (257). The polyurethane resin that forms the cleaning blade 208 (257) is reacted with the isocyanate compound to form an allophanate bond and harden to increase an elastic coefficient and rigidity of the polyurethane resin. As a result, the hardness of the section treated with high hardness 282 is enhanced and the frictional coefficient is reduced, so that durability of the cleaning blade 208 (257) is improved.

More specifically, there is a urethane bond having active hydrogen in the polyurethane resin that forms the cleaning blade 208 (257). In the step 4, it is conceivable that the section treated with high hardness 282 is formed by reacting the urethane bond with the impregnated isocyanate compound to form the allophanate bond. It is also conceivable that a multimerization reaction by the reaction of the isocyanate compounds one another (e.g., carbodiimidization reaction, isocyanuration reaction, and the like) is carried forward simultaneously to contribute to the formation of the section treated with high hardness 282. Alternatively, it is conceivable that the isocyanate compound is nearly consumed by the reaction with moisture in the air to form a white opaque treated layer having the high hardness.

The isocyanate compound including one isocyanate group in its molecule and the isocyanate compound including two or more isocyanate groups in its molecule can be used as the isocyanate compound with which the cleaning blade 208 (257) is impregnated. The isocyanate compound including one isocyanate group in its molecule can include aliphatic monoisocyanate such as octadecylisocyanate (ODI) and aromatic monoisocyanate. The isocyanate compound including two isocyanate groups in its molecule can include 2,4-tolylene diisocyanate, 2,6-tolylene diisocyanate, 4,4'-diphenylmethane diisocyanate (MDI), m-phenylene diisocyanate, tetramethylene diisocyanate, hexamethylene diisocyanate, and the like.

To facilitate the reaction of the isocyanate compound, it is desirable to also impregnate the polyurethane resin with the catalyst in addition to the isocyanate compound. Examples of the catalyst to be used together with the isocyanate compound can include quaternary ammonium salts and carboxylate salts. TMR catalyst manufactured by DABCO and the like can be exemplified as the quaternary ammonium salt. Potassium acetate, potassium octylate, and the like can be exemplified as the carboxylate salt. These catalysts are very viscous or solid upon impregnation. Thus, it is desirable to previously dissolve the catalyst in a solvent, adding the dissolved catalyst to the isocyanate compound, and then impregnating the polyurethane resin with the isocyanate compound and the catalyst.

The contact of the isocyanate compound in the step 1 can be replaced with a method for impregnating a fibrous member or a porous member with the isocyanate compound and then coating the blade with the fibrous member or the porous member or applying the fibrous member or the porous member to the blade using a spray. An optimal region to be applied may be set separately for the cleaning blade 208 and the cleaning blade 257.

A treatment time period for impregnating with the isocyanate compound in the step 2 may be changed appropriately according to the image forming apparatus and the member abutting thereon. The optical treatment time period may be set separately for the cleaning blade 208 and the cleaning blade 257. In order to accomplish a desired range of a treatment level in the finally obtained section treated with high hardness 282, a contact period of the isocyanate compound with the cleaning blade 208 (257) is preferably 5 minutes or more and more preferably 10 minutes or more. However, the contact period is preferably one hour or less, and more preferably 40 minutes or less in consideration of mass productivity.

For wiping out the isocyanate compound in the step 3, it is desirable to sufficiently remove the isocyanate compound adhered to the surface of the blade 208 using the solvent that can dissolve the isocyanate compound. Because, if the excessively residual isocyanate compound after the impregnation is not removed evenly, subtle convex portions are generated on the surface of the section treated with high hardness 282, and become starting points of the toner escape, resulting in defective cleaning performance of the cleaning blade 208 (257). The solvent used for the wiping out includes, for example, toluene, xylene, butyl acetate, and methyl ethyl ketone. A tool used for the wiping out includes, for example, a method for soaking a sponge formed from the polyurethane resin with a small amount of the solvent and rubbing the blade surface with the sponge.

[Swelling of Blade End]

Figure 14:
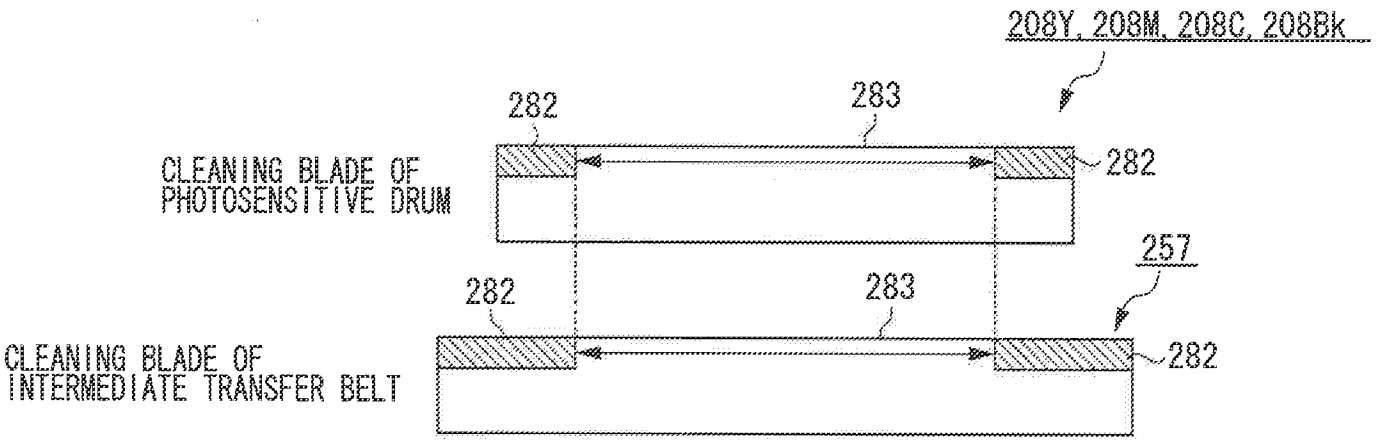
FIG. 14 illustrates a positional relation of untreated sections of cleaning blades in a comparative example 4.

FIG. 14 illustrates a positional relation of the untreated sections in the cleaning blade in a comparative example 4. As illustrated in FIG. 13, the section impregnated with the isocyanate compound in the cleaning blade 208 (257) is swelled in the thickness direction (Y direction). The swelling occurs in the thickness direction (Y direction) by impregnating the cleaning blade 208 (257) formed from the polyurethane resin with the isocyanate compound. A swelled width H is a distance from an edge portion 284 abutting on the drum in the untreated section 283 of the blade 208 to an edge portion 284 abutting on the drum in the section treated with high hardness 282 of the blade 208. A treated width L in the lengthwise direction is a distance from a lengthwise end of the blade 208 to the border between the section treated with high hardness 282 and the untreated section 283 in the edge portion 284 abutting on the drum in the cleaning blade 208 (257). There is a transition region 286, in which the swelled width is gradually reduced from the portion having the swelled width H toward the central portion in the lengthwise direction. Particularly, a region in which the swelled width is reduced to 90% to 10% of the swelled region H is defined as the transition region 286.

When the cleaning blade formed from the urethane resin is impregnated with the isocyanate compound, the swelling occurs. If the treatment with the isocyanate compound is given to a whole region of the lengthwise direction of the cleaning blade, a corrugated deformation occurs in the edge portion 284 abutting on the drum in the cleaning blade. If the corrugated deformation occurs in the region such as an image forming region where the transferred residual toner comes in a large amount, the toner and the external additive potentially escape.

Since only the both ends of the cleaning blade 208 (257) are impregnated with the isocyanate compound, no corrugated deformation occurs in the edge portion 284 abutting on the drum. However, to inhibit the deformation of the edge portion 284 abutting on the drum in the non-image forming region of the both ends in which the friction is large, the hardness of the section treated with high hardness 282 must be sufficiently increased relative to the hardness of the untreated section 283 of the central portion in which the friction is small.

However, when a degree of the treatment for increasing the hardness of the section treated with high hardness 282 is increased, a difference in level occurs in the border between the section treated with high hardness 282 and the untreated section 283 when abutting on the photosensitive drum 201, and the toner sometimes escapes from the difference in level. In the image forming apparatus 110, the toner escaped by small and small from the cleaning blade 208 (208Y, 208M, 208C, 208Bk) from between paper sheets or upon idle rotation is transferred and accumulated onto the intermediate transfer belt 254, and subsequently transferred onto the recording material, resulting in being sometimes visualized as the image defect.

As illustrated in FIG. 14, in the image forming apparatus in the comparative example 4, the toner escaped from the cleaning blade 208 (208Y, 208M, 208C, 208Bk) and transferred onto the intermediate transfer belt (254) can be cleaned by the cleaning blade 257. However, the cleaning performance is partially lowered in the cleaning blade 257 because the both ends thereof are provided with the section treated with high hardness 282, and the escaped toner is not cleaned sufficiently in those sections. In particular, when the untreated width of the cleaning blade 208Y, 208M, 208C, and 208Bk is the same as the untreated width of the cleaning blade 257 and the border positions of the section treated with high hardness 282 and the untreated section 283 are overlapped, it is extremely difficult to clean the escaped toner.

Also in the image forming apparatus 110, it is likely that the toner escaped from the cleaning blade 208 (208Y, 208M, 208C, 208Bk) is adhered and accumulated onto the surface of the charging roller 202 (202Y, 202M, 202C, 202Bk) to prevent the normal contact and causes charging failure at the above border position.

Thus, in the following exemplary embodiment, the arrangement of the untreated section 283 of the cleaning blade 208 and the untreated section 283 of the cleaning blade 257 is optimized to inhibit the image defect along with the toner escape that occurs in the border between the treated section and the untreated section of the cleaning blade 208.

Figure 15:
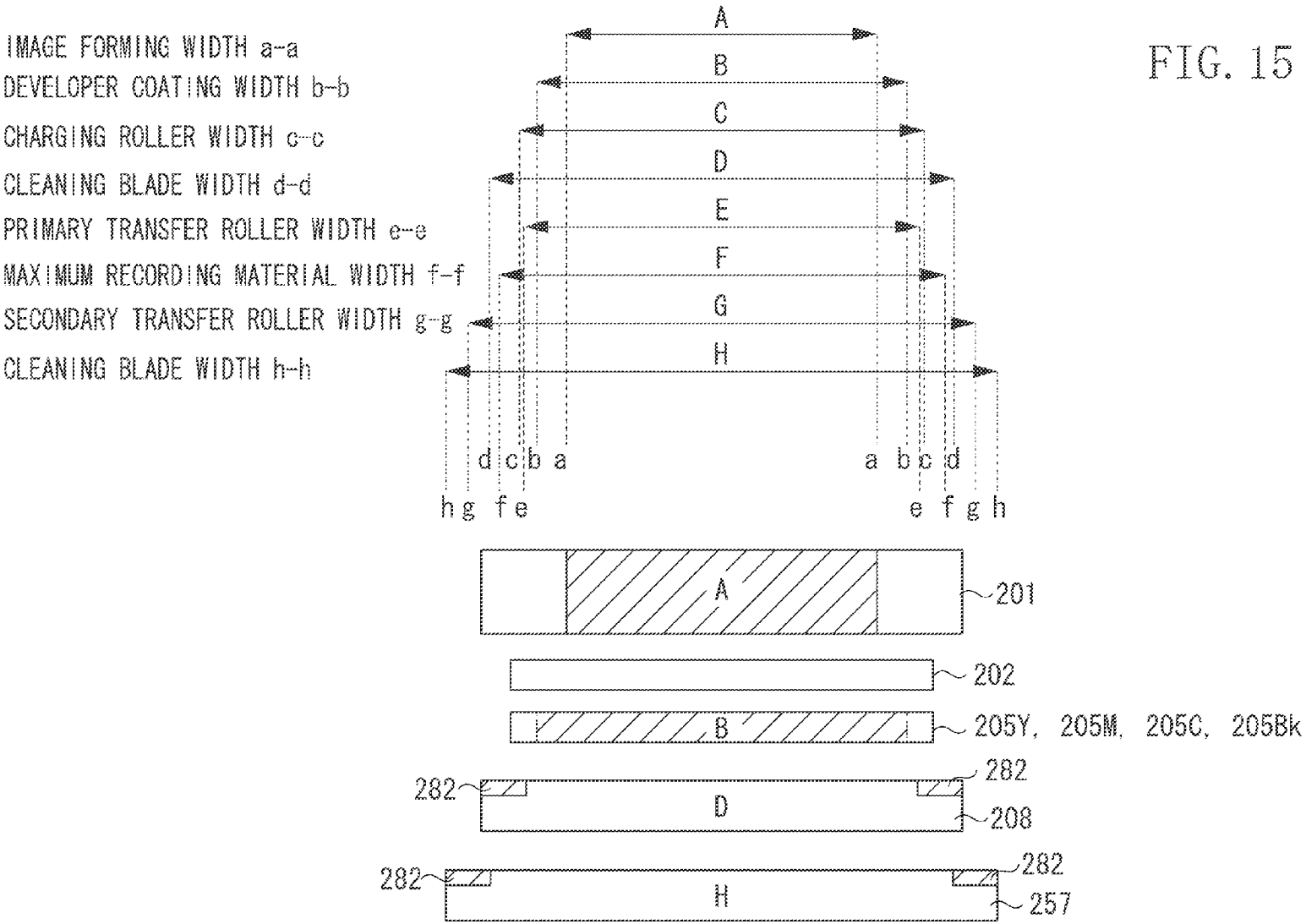
FIG. 15 illustrates a positional relation of respective components in a width direction in a third exemplary embodiment.
Figure 16:
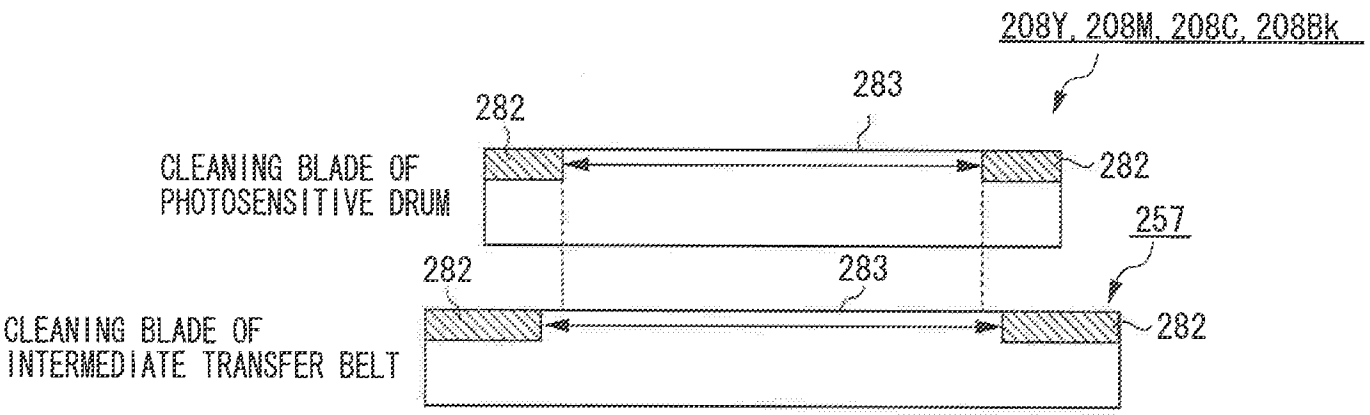
FIG. 16 illustrates a positional relation of untreated sections of cleaning blades in the third exemplary embodiment.

FIG. 15 illustrates a positional relation in the width directions of respective components in a third exemplary embodiment. FIG. 16 illustrates a positional relation of the untreated sections of the cleaning blades in the third exemplary embodiment.

As illustrated in FIG. 9, the intermediate transfer belt 254 that is one example of the intermediate transfer member abuts on the photosensitive drum 201 at the primary transfer section T1, and the toner image is transferred thereon. In the drum cleaning device 207 that is one example of a first cleaning device, a first cleaning blade (208) in which the hardness is increased in its both ends in the width direction orthogonal to the conveyance direction of the toner image abuts on the photosensitive drum 201 passed through the primary transfer section T1. A secondary transfer roller 253 that is one example of a transfer unit allows an electric field to act upon the secondary transfer belt 254 and transfers the toner image onto the recording material at the secondary transfer section T2.

In a belt cleaning device 256 that is one example of a second cleaning device, a second cleaning blade (257) in which the hardness is increased in its both ends in the width direction orthogonal to the conveyance direction of the toner image abuts on the intermediate transfer belt 254 passed through the second transfer section T2. The first cleaning blade 208 and the second cleaning blade 257 are integrally formed from the rubber elastic material, and the hardness is partially increased with swelling by applying the isocyanate cross-linking agent on the both ends in the width direction and treating it with heat.

As illustrated in FIG. 15, a region in the width direction of the cleaning blade 208 in which the hardness thereof is not increased is located inside a region in the width direction of the cleaning blade 257 in which the hardness thereof is not increased. A developing device 204Y develops the electrostatic image formed on the photosensitive drum 201Y. A maximum developing region in the width direction of the developing device 204Y is located inside the region in the width direction of the cleaning blade 208Y in which the hardness thereof is not increased. The charging roller 202Y abuts on the surface of the photosensitive drum 201Y and a predetermined voltage is applied thereto. A whole abutting range of the charging roller 202Y is located inside the region in the width direction of the cleaning blade 208Y in which the hardness thereof is not increased.

An image forming region A in which an image can be formed by an exposure device 203 is set in the width direction orthogonal to the conveyance direction of the toner image on the photosensitive drum 201. The ends of the image forming region A are the ends "a".

In a developing sleeve 205, a toner coating region B capable of carrying the developer over a region covering the image forming region A is set in the width direction orthogonal to the conveyance direction of the toner image in order to enable to develop the image forming region A on the photosensitive drum 201. The ends of the toner coating region B are the ends "b".

A length (width) of the charging roller 202 in the width direction is longer than a length of the toner coating region B so that the toner is not adhered to the photosensitive drum 201 on a more outer side than the toner coating region B. The length of the charging roller 202 corresponds to a charging region C that is the range capable of charging the photosensitive drum 201. The ends of the charging region C are the ends "c".

The length (width) D of the cleaning blade 208 in the width direction is longer than the length of the charging region C. The toner is slightly but potentially adhered to the charging region C on the more outer side than the toner coating region B. Thus, the width of the cleaning blade 208 is set so as to cover the longer range than the charging region C in a rotation axis line direction of the photosensitive drum 201. The ends of the cleaning blade 208 are the ends "d". The sections treated with high hardness 282 impregnated with the isocyanate compound are arranged in the both ends in the width direction of the cleaning blade 208.

The length (width) E of the primary transfer roller 205 in the width direction is set to cover the toner coating region B in order to transfer the toner image developed in the toner coating region B onto the intermediate transfer belt 254. The width E of the primary transfer roller 205 corresponds to a primary transfer region, and the ends of the primary transfer roller 205 are the ends "e".

A maximum recording material width F is the length (width) in the width direction of the range in which the recording material with a maximum size is passed. The ends of the maximum recording material width F are the ends "f". The length (width) G of the secondary transfer roller 253 in the width direction is set to cover the wider range than the maximum recording material width F in order to nip the recording material with the maximum size. The width G of the secondary transfer roller 253 corresponds to a secondary transfer region, and the ends of the secondary transfer roller 253 are the ends "g".

The length (width) H of the cleaning blade 257 in the width direction has the length covering the width of the secondary transfer roller 253 in order to remove the transferred residual toner on the intermediate transfer belt 254 and block the adherence of the toner to the secondary transfer roller 253. The ends of the cleaning blade 257 are the ends "h". The sections treated with high hardness 282 impregnated with the isocyanate compound are arranged in the both ends in the width direction of the cleaning blade 257.

In the third exemplary embodiment, the cleaning blade 257 and the cleaning blade 208 were made in the same manner as described above, except that only the lengths (width) D and H in the width direction were made different and the treated width L of the section treated with high hardness was fixed to 6 mm. In the third exemplary embodiment, the width a-a of the image forming region A is 305 mm, the width b-b of the toner coating region B is 315 mm, the width c-c of the charging region is 319 mm, the width e-e of the primary transfer roller is 316 mm, the maximum recording material width f-f is 320 mm, and the width g-g of the secondary transfer roller is 330 mm.

In the third exemplary embodiment, the width d-d of the cleaning blade 208 in the drum cleaning device 207 is 327 mm, and the width h-h of the cleaning blade 208 in the belt cleaning device 256 is 338 mm. The toner in a minute amount escaped from the border between the section treated with high hardness 282 and the untreated section 283 in the cleaning blade 208 and transferred onto the intermediate transfer belt 254 is caught by the untreated section 283 in the cleaning blade 257. Thus, it becomes possible to prevent the image defect due to the adherence of the toner to the intermediate transfer belt 254.

As illustrated in FIG. 13, in order to assure the hardness required for preventing the deformation of the ends of the cleaning blades 208 and 257, a section treated with high hardness 282 having the swelled width H of 35 μm was formed by giving the treatment with isocyanate for 40 minutes, in which the treated width L was 6 mm.

As illustrated in FIG. 16, the untreated width in the cleaning blade 208 is arranged within the untreated width in the cleaning blade 257 according to the third exemplary embodiment. Thus, the border positions between the section treated with high hardness 282 and the untreated section 283 in the cleaning blade 208 and the cleaning blade 257 are not overlapped.

[Evaluation Experiment for Cleaning Performance]

A blade turn-up and a cleaning performance of the cleaning blades 208 and 257 according to the third exemplary embodiment were evaluated. The blade turn-up is a phenomenon in which a blade edge abutting in a counter direction on a surface receiving a sliding friction is pulled by the surface receiving the sliding friction and is turned outward and deformed as if reversed. The blade turn-up was evaluated under a high temperature and high humidity environment (32.5° C., 80%) that was severe for the blade turn-up. The cleaning performance was evaluated under a low temperature and a low humidity (15° C., 10%) that was severe for the cleaning performance.

A multifunction peripheral iRC3380 made by Canon Inc. was used for the evaluation. Four types of the cleaning blades 208 and 257 according to the third exemplary embodiment described above and comparative examples 4, 5, and 6 described below were mounted in the machine, respectively, and image formation with an image ratio of 5% was continuously performed for 150,000 sheets under each condition.

In an early phase in the use of the cleaning blades 208 and 257, the frictional force between the untreated section 283 of the cleaning blade 208 to which the toner is not supplied and the photosensitive drum 201 is increased to potentially cause the blade turn-up. Thus, a lubricant was previously applied onto the whole region in the lengthwise direction of the cleaning blades 208 and 257, and then the experiment was started. The lubricant used was obtained by dispersing graphite fluoride having an average particle diameter of 3 μm (product name: Cefbon manufactured by Central Glass Co., Ltd.) in a hydrofluoroether (HFE) solvent at a weight ratio of 10%. The lubricant was applied onto the cleaning blades 208 and 257, and subsequently dried in an oven to evaporate the solvent Comparison and results in the evaluation of the blade turn-up and the cleaning performance in the cleaning blades 208 and 257 in the continuous image formation are shown in Table 2.

TABLE 2

| | Third Exemplary Embodiment | Comparative Example 4 | Comparative Example 5 | Comparative Example 6 |
|---|---|---|---|---|
| Relation of untreated lengthwise width between blade 208 and blade 257 | Blade 208 < Blade 257 | Blade 208 = Blade 257 | Blade 208 > Blade 257 | Blade 208 > Blade 257 |
| Swelled width of drum cleaning blade 208 (μm) | 35 | 35 | 35 | 35 |

TABLE 2-continued

| | Third Exemplary Embodiment | Comparative Example 4 | Comparative Example 5 | Comparative Example 6 |
|---|---|---|---|---|
| Swelled width of intermediate transfer member cleaning blade 257 (μm) | 35 | 35 | 35 | 15 |
| Blade turn-up | None | None | Slight | Occurred |
| Image defect due to escaped toner | None | Occurred | Occurred | Occurred |

As illustrated in FIG. 16, the toner escaped from the border position between the section treated with high hardness 282 and the untreated section 283 in the cleaning blade 208 is removed by the untreated section 283 in the cleaning blade 257 according to the third exemplary embodiment. As illustrated in FIG. 10, the escaped toner that is transferred from the photosensitive drum 201 to the intermediate transfer belt 254 and is taken around by the intermediate transfer belt 254 is efficiently removed by the untreated section 283 in the cleaning blade 257. Thus, when the continuous image formation of 150,000 sheets was completed, the escaped toner was not visualized as the image defect on the recording material.

The intermediate transfer belt 254 is reciprocally moved to the width direction (X direction) along with the tilt of the steering roller 260 illustrated in FIG. 9. Thus, the toner escaped from the border position between the section treated with high hardness 282 and the untreated section 283 in the cleaning blade 257 went around and was removed by the section treated with high hardness 282 and the untreated section 283 in the cleaning blade 257. Thus, no toner streak was also observed on the intermediate transfer belt 254.

Comparative Example 4

As illustrated in FIG. 14, in the comparative example 4, the untreated width of the cleaning blade 208 is identical to the untreated width of the cleaning blade 257, and the border positions between the section treated with high hardness 282 and the untreated section 283 are identical in the width direction in the both. Other dimensions and the manufacturing method of the cleaning blades 208 and 257 are the same as in the third exemplary embodiment. Minor toner escape occurred in the cleaning blade 208 and the cleaning blade 257 in the comparative example 4. Although no blade turn-up occurred, the toner slightly escaped from the cleaning blade 208 produced the toner streaks on the intermediate transfer belt 254 and was transferred onto the recording material. Thus, the image was evaluated as the image defect.

Comparative Example 5

In the comparative example 5, the cleaning blades 208 and 257 in the third exemplary embodiment were exchanged. With reference to FIG. 14, in the comparative example 5, the untreated width of the cleaning blade 208 in the drum cleaning device 207 is longer than the untreated width of the cleaning blade 257 in the belt cleaning device 256. The other dimensions and the manufacturing method of the cleaning blades 208 and 257 are the same as in the third exemplary embodiment.

In the cleaning blades 208 and 257 in the comparative example 5, no blade turn-up occurred, but a blade chattering noise that was a warning sign of the blade turn-up occurred. In a latter half of the continuous image formation, the section treated with high hardness 282 in the cleaning blade 257 became unable to collect the toner slightly escaped from the cleaning blade 208 on the intermediate transfer belt 254. Thus, the toner streaks were observed on the intermediate transfer belt 254. Subsequently, the toner streaks were transferred and visualized on the recording material, and thus the result was evaluated as the image defect.

Comparative Example 6

As illustrated in FIG. 14, also in the comparative example 6, the untreated width of the cleaning blade 208 is identical to the untreated width of the cleaning blade 257, and the border positions between the section treated with high hardness 282 and the untreated section 283 are identical in the width direction in the both. However, the degree of the treatment in the section treated with high hardness 282 was weakened to reduce the swelled width. More specifically, a reaction time after impregnating with the isocyanate compound was 10 minutes that was shorter than 40 minutes in the third exemplary embodiment. The other dimensions and the manufacturing method of the cleaning blades 208 and 257 are the same as in the third exemplary embodiment.

In the comparative example 6, the minor toner escape occurred in the cleaning blade 208, but the toner escaped from the cleaning blade 208 was removed on each escape at the border position between the section treated with high hardness 282 and the untreated section 283. However, in an early phase of the continuous image formation when about 5,000 sheets were completed, the turn-up occurred in the cleaning blade 257.

As described above, in the cleaning blades 208 and 257 according to the third exemplary embodiment, the untreated section 283 in the cleaning blade 257 covers the border position between the section treated with high hardness 282 and the untreated section 283 in the cleaning blade 208. Thus, the toner escaped from the cleaning blade 208 and transferred from the photosensitive drum 201 is not accumulated on the intermediate transfer belt 254. Therefore, it is possible to prevent a streak image of the escaped toner from being visualized on the recording material, as well as no turn-up of the cleaning blade 257 occurs. Thus, the image with high quality can continue to output for a long time period.

Figure 17:
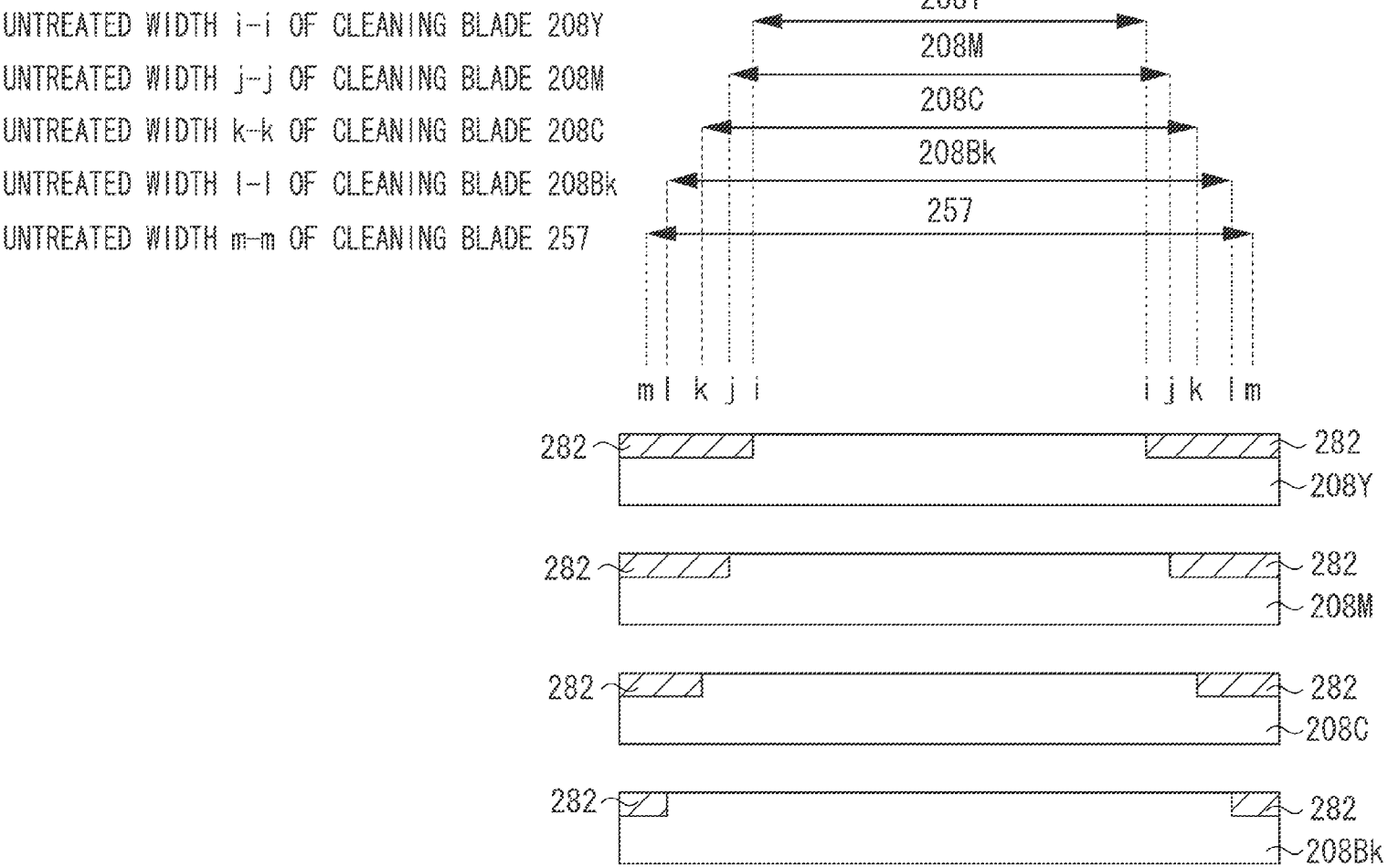
FIG. 17 illustrates a positional relation of untreated sections of cleaning blades in a fourth exemplary embodiment.

FIG. 17 illustrates the arrangement of the cleaning blades in the drum cleaning device in a fourth exemplary embodiment. According to the fourth exemplary embodiment, as illustrated in FIG. 9, the border positions between the section treated with high hardness 282 and the untreated section 283 in the cleaning blades 208Y, 208M, 208C, and 208Bk in the image forming units PY, PM, PC, and PBk are not overlapped in the width direction.

In the fourth exemplary embodiment, a plurality of the photosensitive drums 201Y, 201M, 201C, and 201Bk individually provided with cleaning device 207Y, 207M, 207C, and 207Bk, respectively are arranged along the intermediate transfer belt 254. The regions in which the hardness is not increased in the plurality of the cleaning blades 208Y, 208M, 208C, and 208Bk are different in the width direction.

As illustrated in FIG. 17, as the cleaning device provided for the photosensitive drum located on the more downstream side in the conveyance direction of the toner image, the region in which the hardness is not increased in the cleaning blade is assured on the more outer side in the width direction. The cleaning blades 208Y, 208M, 208C, and 208Bk were made by making the width treated with isocyanate different. Thus, the untreated widths of the cleaning blades 208Y, 208M, 208C, and 208Bk are different one another. According to the fourth exemplary embodiment, the toner escaped from the border position and transferred is not overlapped on the intermediate transfer belt 254 by sifting the border positions between the section treated with high hardness 282 and the untreated section 283 in the cleaning blades 208Y, 208M, 208C, and 208Bk.

Thus, even if the toner in a minute amount is escaped from the cleaning blades 208Y, 208M, 208C, and 208Bk in the image forming units PY, PM, PC, and PBk, the positions at which the escaped toner is to be transferred are shifted on the intermediate transfer belt 254. Therefore, the escaped toner on the intermediate transfer belt 254 can be efficiently collected by the cleaning blade 257.

Further in the fourth exemplary embodiment, in the order of the image forming units PY, PM, PC, and PBk, i.e., the more downstream the cleaning blades 208Y, 208M, 208C, and 208Bk are located at, the longer the untreated width thereof is. Thus, when the toner is escaped from the border position in the cleaning blade on the upstream side and transferred onto the photosensitive drum on the downstream side through the intermediate transfer belt 254, the transferred toner can be efficiently removed by the untreated section 283 in the cleaning blade on the downstream side. Thus, the fourth exemplary embodiment is advantageous in the cleaning performance compared with when the untreated width in the cleaning blades 208Y, 208M, 208C, and 208Bk is shorter on the more downstream side and the escaped toner is removed by the section treated with high hardness 282 in the cleaning blade on the downstream side.

Figure 18:
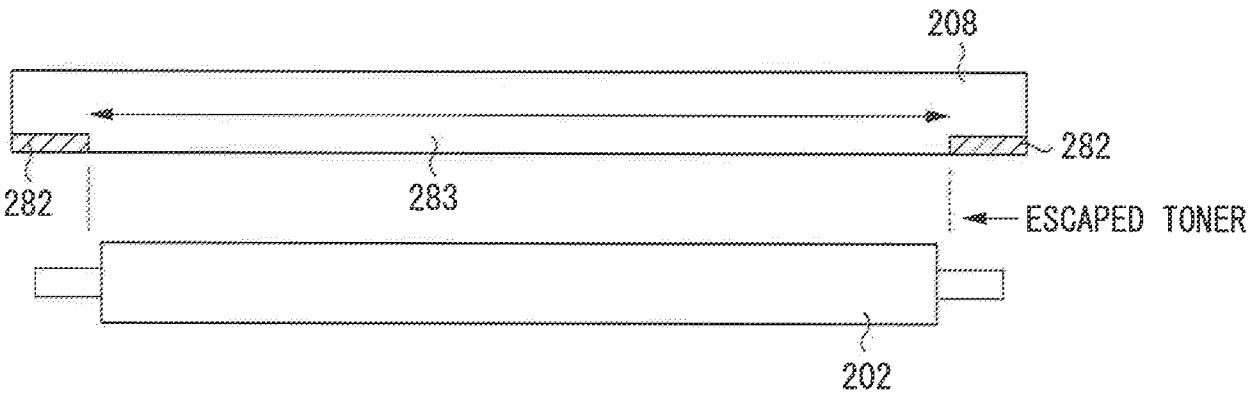
FIG. 18 illustrates a positional relation of a section treated with high hardness and a charging roller in a fifth exemplary embodiment.
Figure 19:
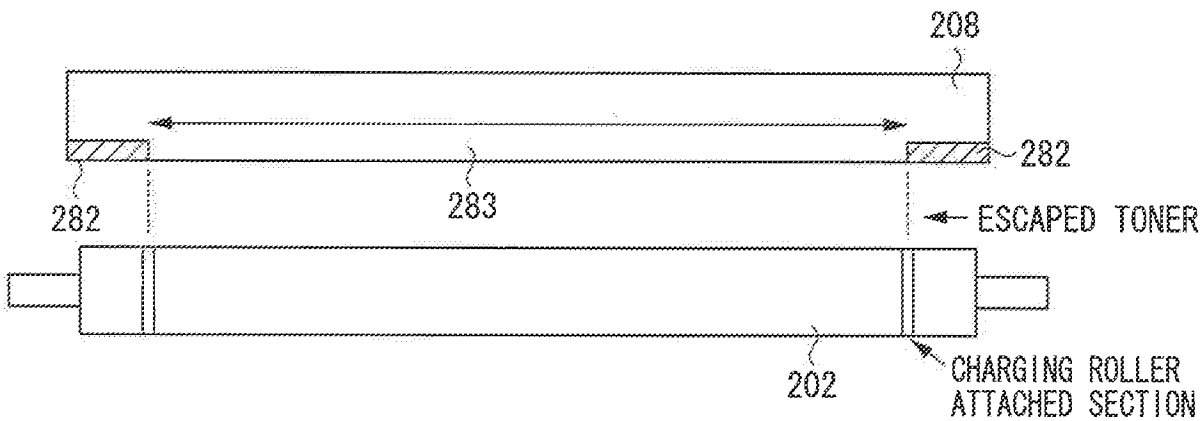
FIG. 19 illustrates a positional relation of a section treated with high hardness and a charging roller in a comparative example 7.

FIG. 18 illustrates a positional relation between the section treated with high hardness and the charging roller in a fifth exemplary embodiment. FIG. 19 illustrates a positional relation between the section treated with high hardness and the charging roller in a comparative example 7.

According to the fifth exemplary embodiment, the untreated width of the untreated section 283 sandwiched with the sections treated with high hardness 282 in the cleaning blade 208 was set to be shorter than the length (width) of the charging roller 2 in the width direction orthogonal to the conveyance direction of the toner image.

As illustrated in FIG. 15, the length of the charging roller 202 corresponds to the charging region C that is the range capable of charging the photosensitive drum 201. The ends of the charging region C are the ends "c", and the width c-c of the charging region is 319 mm. On the contrary, the width d-d of the cleaning blade 208 in the drum cleaning device 207 is 327 mm, and the treated width L of the section treated with the high hardness 282 in the both ends is 3 mm, respectively. Thus, the untreated width that is the length of the untreated section 283 sandwiched with the sections treated with high hardness 282 in the cleaning blade 208 is 321 mm, and is set to be 2 mm wider than the width c-c of the charging region C. The other dimensions and the manufacturing method of the cleaning blades 208 and 257 are the same as in the third exemplary embodiment. As illustrated in FIG. 13, the drum cleaning blade 208 was treated with isocyanate for 40 minutes, and the swelled width was 35 μm that was the same as in the third exemplary embodiment.

[Evaluation Experiment for Cleaning Performance]

Using the same machine for evaluation and the same conditions as in the third exemplary embodiment, the cleaning blades 208 and 257 according to the fifth exemplary embodiment, and those in comparative examples 7, 8, and 9 described below were evaluated in the same manner as in the third exemplary embodiment. The method for testing is the same as in the third exemplary embodiment. Four types of the cleaning blades 208 and 257 according to the fifth exemplary embodiment and the comparative examples 7, 8, and 9 were mounted in the machine for evaluation, respectively, and image formation with an image ratio of 5% was continuously performed for 150,000 sheets under each condition. Comparison and results in the evaluation of the blade turn-up and the cleaning performance in the cleaning blades 208 and 257 in the continuous image formation are shown in Table 3.

TABLE 3

| | Fifth Exemplary Embodiment | Comparative Example 7 | Comparative Example 8 | Comparative Example 9 |
|---|---|---|---|---|
| Relation between untreated width of blade 208 and charging region C in lengthwise width | Charging region C < Untreated width | Charging region C > Untreated width | Charging region C = Untreated width | Charging region C < Untreated width |
| Swelled width of drum cleaning blade 208 (μm) | 35 | 35 | 35 | Untreated |
| Blade turn-up | None | None | None | Occurred |
| Image defect due to escaped toner | None | Occurred | Slight | None |

As shown in Table 3, in the cleaning blades 208 and 257 according to the fifth exemplary embodiment, after 150,000 sheets of the continuous image formation was completed, no image defect due to the toner escape occurred on the recording material, and no turn-up occurred in the cleaning blades 208 and 257.

As illustrated in FIG. 18, the minor toner escape occurred on the photosensitive drum 201 from the cleaning blade 208 in the fifth exemplary embodiment, but the toner escaped from the cleaning blade 208 is passed outside the charging roller 202 and is not adhered to the charging roller 202. The toner in a minute amount escaped from the border between the section treated with high hardness 282 and the untreated section 283 and taken around on the photosensitive drum 201 is passed outside the charging roller 202. Thus, the adherence of the toner to the charging roller 202 can be avoided. As a result, charging unevenness due to the adherence of the toner to the charging roller 202 is prevented, and it becomes possible to prevent the image defect caused by the charging unevenness.

Comparative Example 7

As illustrated in FIG. 18, the width c-c of the charging region is 319 mm also in the comparative example 7. On the contrary, the width d-d of the cleaning blade 208 in the drum cleaning device 207 is 327 mm and the treated width L of the section treated with high hardness in the both ends is 6 mm, respectively. As a result, in the comparative example 7, the untreated width in the drum cleaning blade 208 is 315 mm, which is about 2 mm shorter on one side than the charging region C. The other dimensions and the manufacturing method of the cleaning blades 208 and 257 are the same as in the third exemplary embodiment.

As illustrated in FIG. 19, no blade turn-up occurred in the cleaning blade 208 in the comparative example 7, but the toner escaped from the cleaning blade 208 was adhered onto the charging roller 202. As a result, when the continuous image formation were repeated for 5,000 sheets, the image defect due to the charging failure occurred within the image forming region.

Comparative Example 8

As illustrated in FIG. 18, the width c-c of the charging region is 319 mm also in the comparative example 8. On the contrary, the width d-d of the cleaning blade 208 in the drum cleaning device 207 is 327 mm and the treated width L of the section treated with high hardness in the both ends is 4 mm, respectively. As a result, in the comparative example 8, the untreated width in the drum cleaning blade 208 is 319 mm, which is the same as the width of the charging region C. The other dimensions and the manufacturing method of the cleaning blades 208 and 257 are the same as in the third exemplary embodiment.

In the comparative example 8, no blade turn-up occurred in the cleaning blade 208, but the toner escaped from the cleaning blade 208 was adhered to the ends of the charging roller 202. As a result, when the continuous image formation were repeated for 10,000 sheets, a phenomenon that the ends in the width direction of the recording material were stained with the toner occurred.

Comparative Example 9

In the comparative example 9, the treatment with isocyanate was omitted, and the section treated with high hardness 282 was not formed in the cleaning blades 208 and 257 to make the whole region in the width direction the untreated section 283.

In the comparative example 9, the toner escape did not occur in the cleaning blade 208 because there was no border position between the section treated with high hardness 282 and the untreated section 283. No image defect thus occurred because the charging roller 202 was not stained. However, when 20,000 sheets of the continuous image formation were completed, the blade turn-up occurred starting from the ends under the high temperature and high humidity environment (32.5° C., 80%) that was severe for the blade turn-up.

The combination of the drum cleaning device with the belt cleaning device of the present invention can be applied to not only the image forming apparatus including the intermediate transfer belt but also the image forming apparatus including a recording material conveyance belt.

In a sixth exemplary embodiment, the recording material conveyance belt that is one example of a recording material conveyance member carries the recording material, and the toner image is transferred from the photosensitive drum onto the recording material at the transfer section. The drum cleaning device is arranged to the photosensitive drum, and a first cleaning blade abuts on the photosensitive drum. The belt cleaning device is arranged to the recording material conveyance belt, and a second cleaning blade abuts on the recording material conveyance belt.

The treatment in which the friction is reduced by increasing the hardness along with volume swelling is given to the both ends of the first cleaning blade and the second cleaning blade in the width direction orthogonal to the conveyance direction of the toner image. A region in the width direction of the first cleaning blade in which the hardness thereof is not increased is positioned inside a region in the width direction of the second cleaning blade in which the hardness thereof is not increased.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2011-124583 filed Jun. 2, 2011 and No. 2012-053948 filed Mar. 12, 2012, which are hereby incorporated by reference herein in their entirety.

What is claimed is:

1. An image forming apparatus comprising:

an image bearing member on which an electrostatic latent image is formed;

a developing device configured to develop the electrostatic latent image on the image bearing member to make a toner image;

a first blade member including a first treated section treated with high hardness in both ends of an abutting portion abutting on the image bearing member and configured to remove a toner remained on the image bearing member;

an intermediate transfer member configured to transfer the toner image from the image bearing member and carry the toner image; and a second blade member including a second treated section treated with high hardness in both ends of an abutting portion abutting on the intermediate transfer member and configured to remove toner remained on the intermediate transfer member, wherein the first blade member includes a first region in which a layer thickness of the first blade member is changed at a border between the first treated section and an untreated section which is not treated with high hardness, the second blade member includes a second region in which a layer thickness of the second blade member is changed at a border between the second treated section and an untreated section which is not treated with high hardness, and the second region is provided on a more outer side than the first region in an axis line direction of the image bearing member.

2. The image forming apparatus according to claim 1, wherein an increased amount of a thickness of the first and second blade members in the first region and the second region is 10% or more and 90% or less relative to a maximum increased amount in the first treated section and the second treated section.

3. The image forming apparatus according to claim 1, wherein the first and second blade members are made of a rubber member and the first treated section and the second treated section are treated by impregnating the rubber member with an isocyanate compound.

4. The image forming apparatus according to claim 1, further comprising a plurality of image forming units including at least the image bearing member and the first blade member abutting on the image bearing member, wherein respective first regions in a plurality of the first blade members are not overlapped in the axis line direction of the image bearing member.

5. The image forming apparatus according to claim 4, wherein the plurality of the image forming units is arranged side by side in the intermediate transfer member and each of the first region in the plurality of the first blade members is formed on a more outer side in the axis line direction of the image bearing member as the image forming unit is arranged on a more downstream side of a rotation direction of the intermediate transfer member.

6. An image forming apparatus comprising:

an image bearing member on which an electrostatic latent image is formed;

a developing device configured to develop the electrostatic latent image on the image bearing member to make a toner image;

a first blade member including a first treated section treated with high hardness in both ends of an abutting portion abutting on the image bearing member and configured to remove a toner remained on the image bearing member;

an intermediate transfer member configured to transfer the toner image from the image bearing member and carry the toner image; and a second blade member including a second treated section treated with high hardness in both ends of an abutting portion abutting on the intermediate transfer member and configured to remove toner remained on the intermediate transfer member, wherein a width of an untreated section not treated with high hardness in an abutting portion of the second blade member is longer than a width of an untreated section not treated with high hardness in an abutting portion of the first blade member in an axis line direction of the image bearing member.

7. The image forming apparatus according to claim 6, further comprising a plurality of image forming units including at least the image bearing member and the first blade member abutting on the image bearing member, wherein widths of the untreated sections in the abutting portions of a plurality of the first blade members are different.

8. The image forming apparatus according to claim 7, wherein the plurality of image forming units is arranged side by side in the intermediate transfer member and the width of the untreated section in the abutting portion of the plurality of the first blade members is lengthened as the first blade member is located toward a downstream side in a rotation direction of the intermediate transfer member.

* * * * *